US010781579B2

(12) United States Patent
Mu et al.

(10) Patent No.: US 10,781,579 B2
(45) Date of Patent: Sep. 22, 2020

(54) EXTRACTION-TYPE WATER DISCHARGING DEVICE

(71) Applicant: XIAMEN SOLEX HIGH-TECH INDUSTRIES CO., LTD., Xiamen (CN)

(72) Inventors: Weihai Mu, Xiamen (CN); Chunjie Hong, Xiamen (CN); Wenxing Chen, Xiamen (CN); Mingnan Wang, Xiamen (CN)

(73) Assignee: XIAMEN SOLEX HIGH-TECH INDUSTRIES CO., LTD., Xiamen, Fujian Province (CN)

( * ) Notice: Subject to any disclaimer, the term of this patent is extended or adjusted under 35 U.S.C. 154(b) by 15 days.

(21) Appl. No.: 16/160,053

(22) Filed: Oct. 15, 2018

(65) Prior Publication Data

US 2019/0249401 A1 Aug. 15, 2019

(30) Foreign Application Priority Data

Feb. 9, 2018 (CN) ..... 2018 1 0133795
Feb. 9, 2018 (CN) ..... 2018 2 0239768 U

(51) Int. Cl.
*E03C 1/04* (2006.01)
*B05B 1/16* (2006.01)

(52) U.S. Cl.
CPC ..... *E03C 1/0404* (2013.01); *B05B 1/16* (2013.01); *E03C 2001/0415* (2013.01)

(58) Field of Classification Search
USPC ..... 137/801
See application file for complete search history.

(56) References Cited

U.S. PATENT DOCUMENTS 3,181,895 A * 5/1965 Cator ..... F16L 37/004 285/1
4,091,998 A 5/1978 Peterson
6,877,172 B2 * 4/2005 Malek ..... E03C 1/0404 239/587.1

(Continued)

FOREIGN PATENT DOCUMENTS

DE 202006010072 U1 9/2006
EP 3228763 A1 10/2017

OTHER PUBLICATIONS

The EESR issued Apr. 16, 2019 by the EP Office.

*Primary Examiner* — Daphne M Barry
(74) *Attorney, Agent, or Firm* — Yunling Ren

(57) ABSTRACT

An extraction-type water discharging device includes an outlet portion, a support member, a hose passing through the support member and communicating with the hose, and a resetting member. The outlet portion is provided with a first guide structure, and the support member is provided with a second guide structure. One of the first and second guide structures is a convex guide surface, and the other one is a concave guide surface cooperating with the convex guide surface. The convex guide surface is smoothly tapered from a base portion to a top portion. The convex guide surface has a sectional shape of a smooth curve eccentric towards radial direction. The first and second guide structures are configured to, under the action of the reset member, guide a radial alignment and an axial rotational movement such that the outlet portion reset to be aligned with and fits on the support member.

20 Claims, 34 Drawing Sheets

(56) References Cited

U.S. PATENT DOCUMENTS

| | | | | |
|---|---|---|---|---|
| 2004/0135009 | A1 | 7/2004 | Malek et al. | |
| 2006/0283511 | A1 | 12/2006 | Nelson | |
| 2014/0026980 | A1* | 1/2014 | Esche | E03C 1/0404 137/315.01 |
| 2014/0069520 | A1* | 3/2014 | Esche | E03C 1/0404 137/315.01 |
| 2014/0251451 | A1* | 9/2014 | Yang | E03C 1/0404 137/315.01 |
| 2016/0237663 | A1* | 8/2016 | Myers | E03C 1/0404 |

* cited by examiner

EXTRACTION-TYPE WATER DISCHARGING DEVICE

CROSS REFERENCE

The present disclosure claims priority to Chinese Patent Application No. 201810133795.1, filed on Feb. 9, 2018 and titled "Extraction-type Water Discharging Device", and the entire contents thereof are incorporated herein by reference.

TECHNICAL FIELD

The present disclosure generally relates to a sanitary ware technology, and in particular, to an extraction-type water discharging device an automatically guided resetting function which is easy to manufacture.

BACKGROUND

Conventional extraction-type water discharging devices, such as extraction-type kitchen showerheads, have an outlet end (shower head) which will be retracted back by the gravity of a counterweight so as to fit on the end surface of a support member when not in use, and which will be reset by the gravity of the counterweight after it has been extracted out for use. However, in such a conventional kitchen faucet, the reset of the showerhead only depends on the gravity of a lead block, and the reset is not complete and the showerhead is prone to stop at 1~2 mm from the mouth of a pipe. Moreover, the orientation of the showerhead is uncertain, and it has to be inserted by manually aligning and fitting the shower bumps into the grooves of the showerhead sockets.

There is an existing extraction-type mechanically guided reset water discharging device in which a two-point symmetrical guide structure is used between the water discharging end and the end surface of the support member. In this manner, the length of the straight section of the support member that is occupied by the reset is longer, which affects the aesthetics of the appearance of the water discharging device, and will reduce height of the point where the water drops.

At present, there is also an extraction-type guided reset kitchen faucet, which realizes automatically guided reset of the showerhead with mutual attraction and repulsion of two single-sided multi-pole magnets. The single-sided multi-pole magnets of this type are more costly than the common one-sided single-pole magnets, and additionally have a series of hidden problems, such as the magnetic pole orientation has to be identified in production and assembly and fool has to be proofed. Moreover, the magnets have a small range of angle for realizing guide reset. There is also a problem that the reset direction is not easy to control.

SUMMARY

An embodiment of the present disclosure provides an extraction-type water discharging device comprising a support member, a hose and an outlet portion. The outlet portion is in communication with one end of the hose. The other end of the hose passes through the support member. A resetting member acts on the hose so that the outlet portion is reset to abut against and fit on the support member. The outlet portion is provided with a first guide structure corresponding to the support member, and the support member is provided with a second guide structure corresponding to the outlet portion. One of the first and second guide structures is a convex guide surface, and the other one is a concave guide surface cooperating with the convex guide surface. The convex guide surface is smoothly tapered from a base portion to a top portion, and the concave guide surface flares smoothly and gradually from a bottom portion to a top portion, and the sectional shapes of the convex guide surface and the concave guide surface are a smooth curve eccentric in at least one radial direction. Under the resetting force of the reset member, the first and second guide structures can guide a radial alignment and an axial rotational movement so that the outlet portion is aligned with and fits on the support member.

According to an embodiment of the present disclosure, the convex and concave guide surfaces have a sectional shape of a radially symmetrically eccentric smooth curve; or, the convex and concave guide surfaces have a sectional shape of a radially asymmetrically eccentric smooth curve.

According to an embodiment of the present disclosure, the convex and concave guide surfaces have a shape, as seen from side, of an axially symmetrical smooth curve; or the convex and concave guide surfaces have a shape, as seen from side, of an axially asymmetric smooth curve.

According to an embodiment of the present disclosure, the convex guide surface has a sectional shape of an ellipse.

According to an embodiment of the present disclosure, the ratio of the Y-axis to the X-axis of the ellipse is a, where $0.2 \leq a < 1$ or $1 < a$.

According to an embodiment of the present disclosure, the first guide structure is the convex guide surface which is embedded into the concave guide surface provided in an end surface of the support member when the outlet portion abuts against and fits on and the support member.

According to an embodiment of the present disclosure, the outlet portion has an outer shape with directionality, the convex guide surface has a sectional shape of an ellipse, and the outer shape with directionality of the outlet portion is enabled to reset following the convex guide surface when the outlet portion has been extracted and then reset relative to the support member.

According to an embodiment of the present disclosure, the support member is further provided with a magnetically attracting device corresponding to the outlet portion to generate a magnetic attraction force for the outlet portion.

According to an embodiment of the present disclosure, the support member further comprises a socket which is positioned at a front end of the support member, and is provided with the second guide structure corresponding to the outlet portion.

According to an embodiment of the present disclosure, the outlet portion has a first abutment surface at an outer side of the first guide structure, and the socket has a second abutment surface at an outer side of the first guide structure. When the outlet portion is brought into abutment against and fitness on the support member, the first abutment surface abuts against and fits on the second abutment surface.

According to an embodiment of the present disclosure, the hose has an outlet joint at one end thereof, the outlet portion comprises a mandrel, a guide joint and a magnetic material joint, the outlet joint is docked with an inlet end of the mandrel, and has an outer side sequentially screwed and fixed by the guide joint and the magnetic material joint so as to press tight an interface of the hose and the outlet portion, the magnetic material joint corresponds to the magnetically attracting device in the support member, and the first guide structure is formed at the outer side of the guide joint.

BRIEF DESCRIPTION OF THE DRAWINGS

The various objects, features, and advantages of the present disclosure will become more apparent from the following detailed description of preferred embodiments of the present disclosure in conjunction with the accompanying drawings. The drawings are merely exemplary illustration of the present disclosure and are not necessarily drawn to scale. The same reference numerals denote the same or similar components throughout the drawings, in which.

Figure 1:
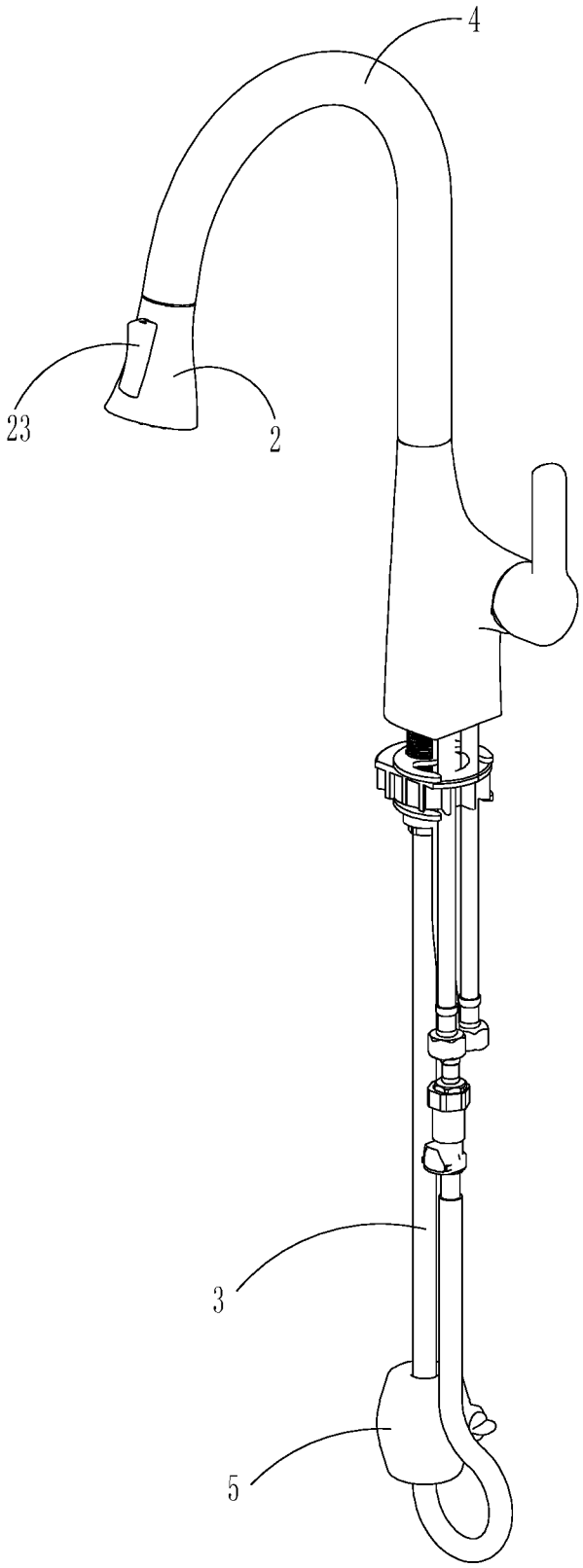
FIG. 1 is a schematic structural view of an extraction-type water discharging device according to an exemplary embodiment.

List of references: 2-outlet portion; 21-first guide structure; 22-convex guide surface; 221-base portion; 222-top portion; 223-rounded corner; 23-water-spray switching button; 24-first abutment surface; 25-mandrel; 251-inlet end; 252-lumen; 26-guide joint; 27-magnetic material joint; 28-housing; 3-hose; 31-one end; 32-another end; 33-outlet joint; 34-C-typed snap ring; 4-support member; 41-second guide structure; 42-concave guide surface; 43-socket; 44-magnetically attracting device; 45-second abutment surface; 5-second abutment surface; YF-long-axial direction; P-contact point; A-deflection angle; H-axial guidance space.

DETAILED DESCRIPTION

Example embodiments will now be described more fully with reference to the accompanying drawings. However, the example embodiments can be implemented in various forms and should not be construed as limited to the embodiments set forth herein; rather, these embodiments are provided to render the present disclosure to be full and complete, and to fully convey the concept of the example embodiments to those skilled in the art. The same reference numerals in the drawings denote the same or similar structures, and thus their detailed description will be omitted.

One of the main objectives of the present disclosure is to overcome at least one of the drawbacks of the prior art described above, and to provide an extraction-type water discharging device with an automatically guided reset function that is easy to manufacture and has a low cost.

Figure 2:
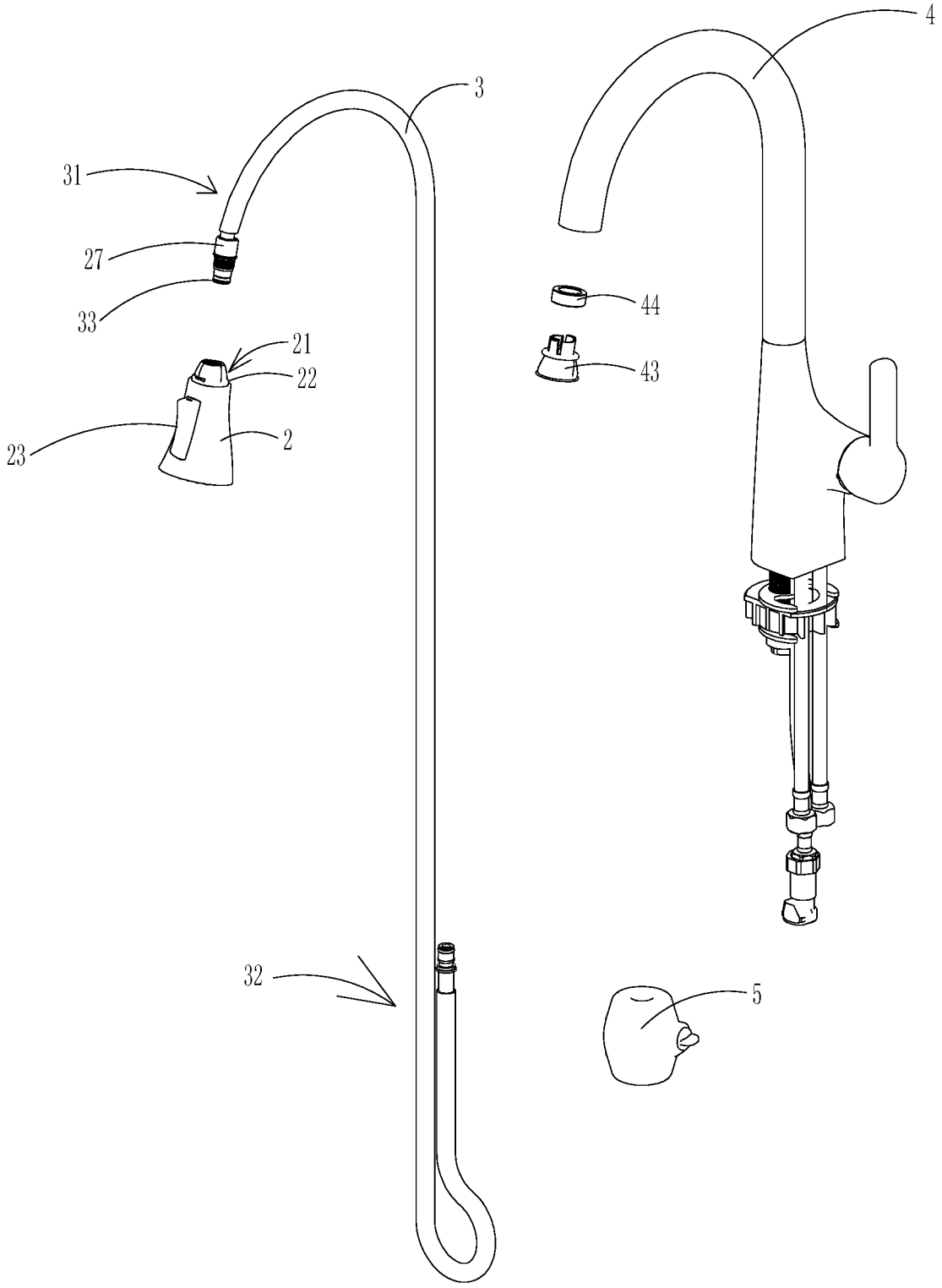
FIG. 2 is a schematic exploded view of components of an extraction-type water discharging device according to an exemplary embodiment.
Figure 6:
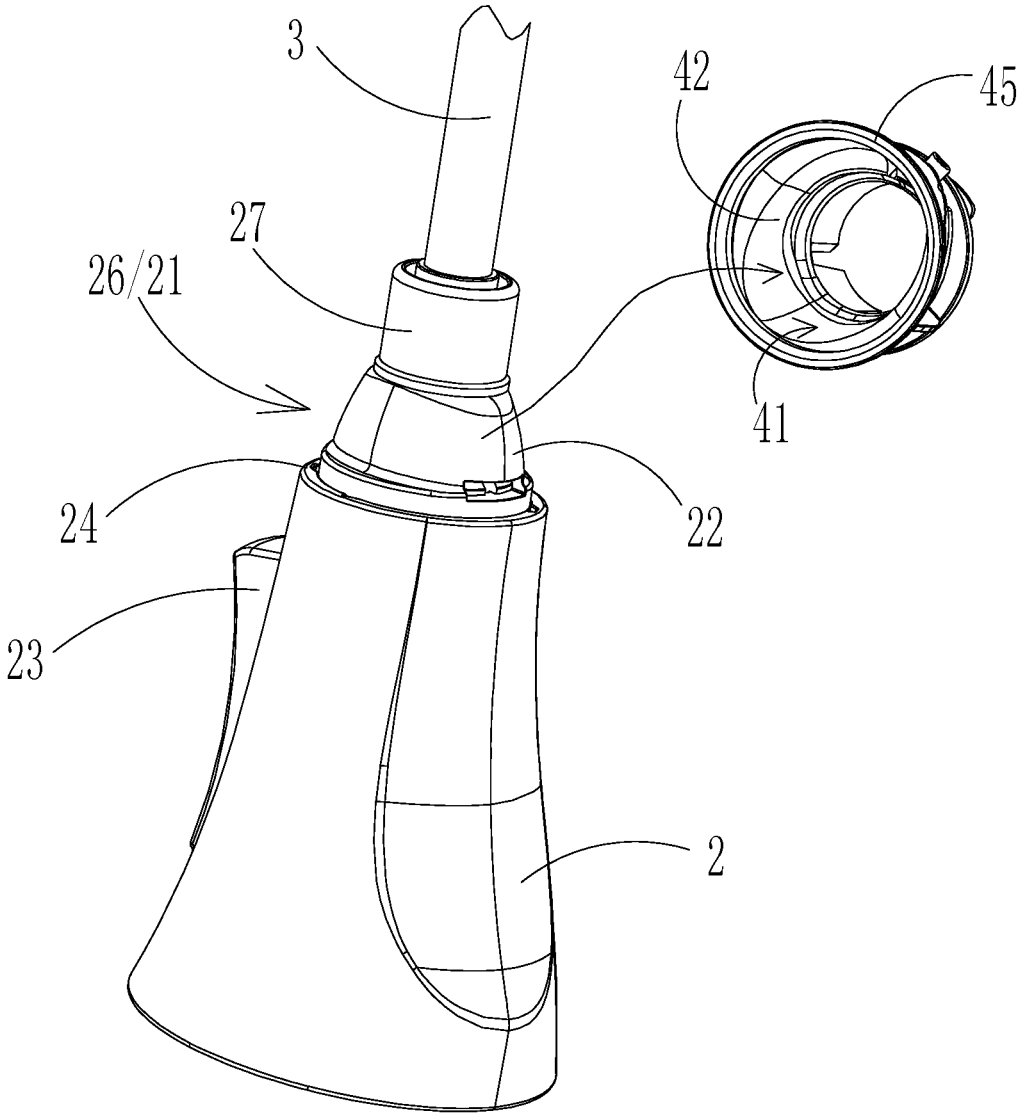
FIG. 6 is a schematic view illustrating the working principle between the main guide components of an extraction-type water discharging device according to an exemplary embodiment.

FIG. 1 is a schematic structural view of an extraction-type water discharging device according to an exemplary embodiment. FIG. 2 is a schematic exploded view of components of an extraction-type water discharging device according to an exemplary embodiment. FIG. 6 is a schematic view illustrating the working principle between the main guide components of an extraction-type water discharging device according to an exemplary embodiment. The embodiments of the present disclosure disclose an extraction-type water discharging device exemplified by a kitchen showerhead which may be also referred to as a kitchen faucet. Of course, those skilled in the art should understand that the so-called water discharging device may also be other water discharging devices having similar requirements.

Figure 15:
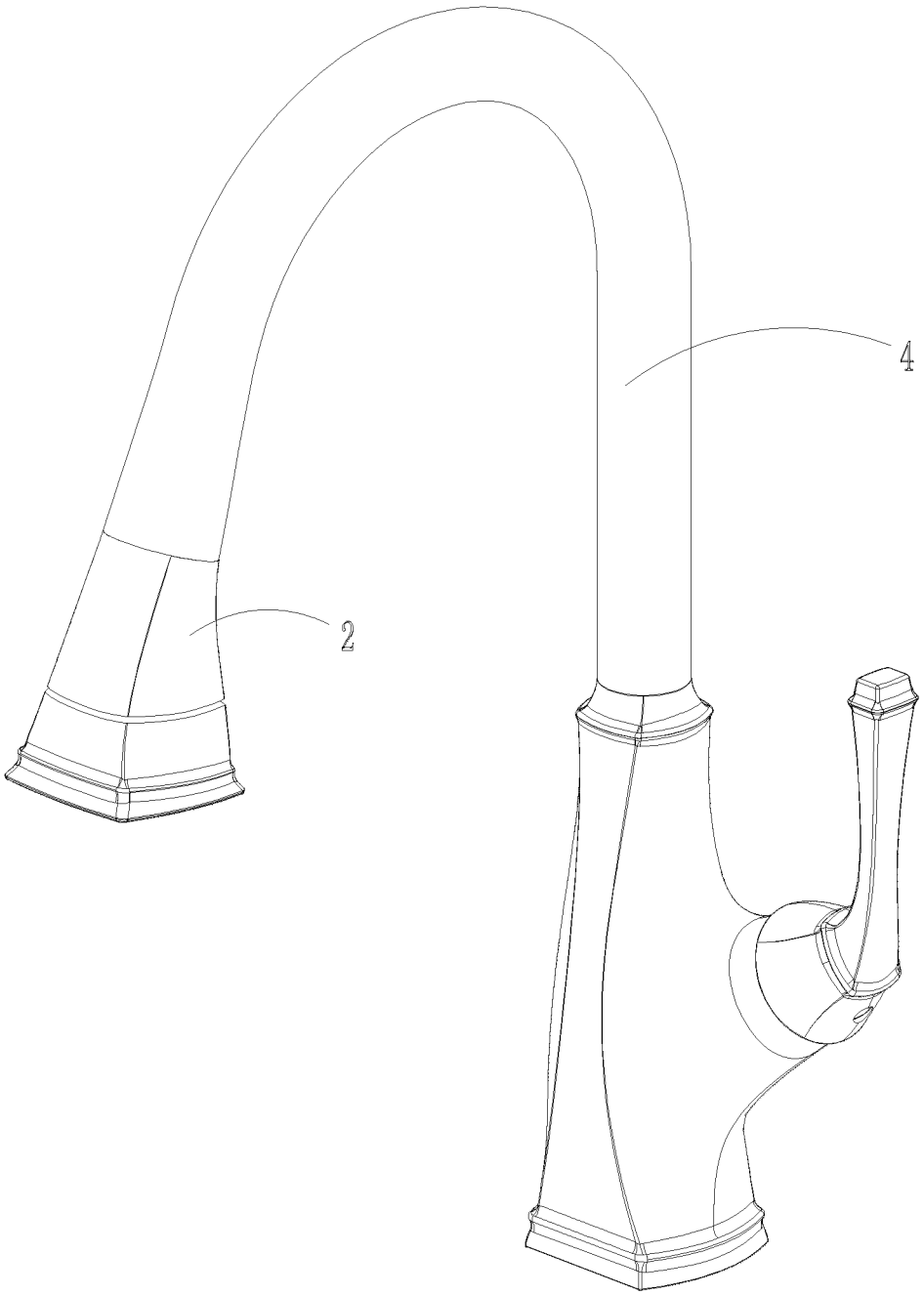
FIG. 15 is a schematic structural view of appearance of an extraction-type water discharging device according to another exemplary embodiment.

As shown in the figures, the extraction-type water discharging device in the embodiment mainly comprises an outlet portion 2, a hose 3 and a support member 4. The outlet portion 2 is in communication with one end 31 of the extractable hose 3. Both of them can be optionally fixedly connected through a common pipe joint structure and achieve communication between internal pipes. The other end 32 of the hose 3 passes through the support member 4 and is connected with the pipeline for incoming water. A reset member 5 may act on the hose 3 and reset the outlet portion 2 and the support member 4 to abutment and fitness by means of the resetting force of the reset member 5. As shown in the figures, the outlet portion 2 may be optionally provided with a water-spray switching button 23 that can control the water-spray switch to facilitate switch of mode of spray after the outlet portion 2 is extracted. It may be considered that the outer shape of the outlet portion 2 has directionality. For another example, please see another directional example as illustrated in FIG. 15. Alternatively, instead of the water-spray switching button 23, the spray may be switched by rotation. The special practice is not limited thereby.

The support member 4 may be a conduit having a smooth curvature. The other end 32 of the hose 3 may be connected with the reset member 5 of which the direction of the reset force may be steered by the smooth curvature of the support member 4 and converted into upward pulling force of the outlet portion 2. Of course, it should be understood that the support member 4 may optionally not be provided with a smooth curvature if the outlet portion 2 requires a downward pulling force. In the embodiment of the present disclosure, a specific example of the reset member 5 is a counterweight having a through hole. The other end 32 of the hose 3 passes through the through hole and is assembled and fixed. The other end 32 of the hose 3 is arc-shaped and relies on the weight of the counterweight to achieve a reset force. It should be understood that the manner of realizing the reset member is not limited to relying on the weight of the counterweight. For example, it can also be realized by a spring. The elastic force can be used to reset the outlet portion to abut against and fit on the support member. Alternatively, the outlet portion is reset to abut against and fit on the support member by means of electrically powered pulling force. It should be understood by those skilled in the art that the reset member may also be implemented in another more ways, and there is not a particular limitation thereto.

As shown in FIG. 2, in the embodiment, the outlet portion 2 is provided with a first guide structure 21 corresponding to the support member 4, and the support member 4 is provided with a second guide structure 41 (see FIG. 6) corresponding to the outlet portion 2. One of the first guide structure 21 and the second guide structure 41 may be optionally a convex guide surface 22, and the other one may be optionally a concave guide surface 42 cooperating therewith. The convex guide surface 22 is smoothly tapered from the base portion 221 to the top portion 222 (refer to FIGS. 10A and 10B), and the top portion 222 also has a structure of rounded corners 223. The concave guide surface 42 flares smoothly gradually from a bottom portion to a top portion. Both the convex guide surface 22 and the concave guide surface 42 have a sectional shape which is at least a radially eccentric smooth curve (refer to FIGS. 10C and 10D). With the reset force of the reset member 5, the first guide structure 21 and the second guide structure 41 may be guided to perform radial alignment and axial rotation so that the outlet portion 2 is aligned with and fits on and the support member 4.

As shown in FIG. 6, the first guide structure 21 of the outlet portion 2 is a convex guide surface 22, and the second guide structure 41 of the support member 4 is a concave guide surface 42 which fits the convex guide surface 22 with clearance. In this way, after they completely fit on each other by guidance and alignment, the guide structures may be entirely accommodated in the front end of the support member 4, making a full use of the inner space in the front end of the support member 4. It should be understood that the convex and concave configurations of both the first guide structure 21 and the second guide structure 41 may also be interchanged with each other as required. For example, the first guide structure 21 is configured as a concave guide surface, and the second guide structure 41 is configured as a convex guide surface.

In the structure shown in the figures, during retraction and reset of the outlet portion 2, the convex guide surface 22 is embedded into the concave guide surface 42 provided on the end surface of the support member 4 when the outlet portion 2 abuts against and fits on the support member 4. The radially eccentric smooth curve of the outer surface of the convex guide surface 22 of the outlet portion 2 may be used to match the radially eccentric smooth curve of the concave guide surface 42 of the second guide structure 41. The convex guide surface 22 and the inner concave guide surface 42 are similar in shape and size and have parallel fitting clearance. When the convex guide surface 22 falls into the concave guide surface 42, if not aligned, the convex guide surface 22 and the concave guide surface 42 have only two unbalanced small contact points, and cannot reach equilibrium. In such a case, the outlet portion 2 with the convex guide surface 22 will be automatically rotated and guided along the inner surface of the concave guide surface 42 to reset, forcing the convex guide surface 22 to completely fall into the inner surface. Finally, the two curved surfaces become parallel, the end surfaces of the outlet portion 2 and the end surface of the showerhead socket 43 fit on each other.

According to the current understanding, in the extraction-type water discharging device provided by the embodiment of the present disclosure, the two guide surfaces may be directly molded, and do not have to be re-assembled or re-molded with other guide components. The automatic resetting guide structure thereof has advantages of simple structure and low cost. Moreover, because there are no other assembly parts, it also has the advantage of stable structure and low structural failure rate.

The so-called here "smooth curve eccentric in at least one radial direction" refers to be eccentric to at least one radial direction. The so-called "eccentric" refers to be offset from the center of the circle to form a non-circular shape so as to have the ability of direction selection. Meanwhile the outer shape is a closed smooth curve in order to facilitate smooth sliding guide. The smooth curve eccentric in at least one radial direction is, for example, generally a cam shape or an elliptical shape (see FIG. 10D).

According to an embodiment of the present disclosure, the sectional shape of the convex guide surface 22 and the concave guide surface 42 is a radially symmetrically eccentric smooth curve, similar to a symmetrical cam. Optionally there are two directions for alignment to give the user more choices.

Figure 10A:
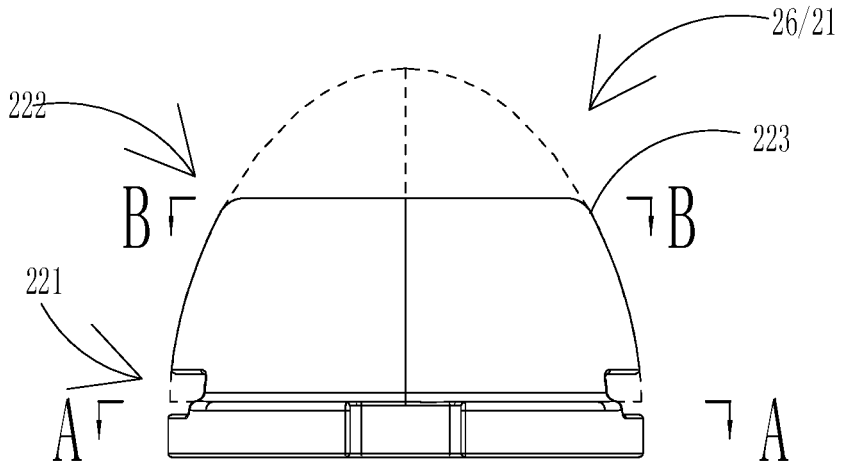
FIG. 10A is a schematic front view of a first guide structure according to an exemplary embodiment.
Figure 10B:
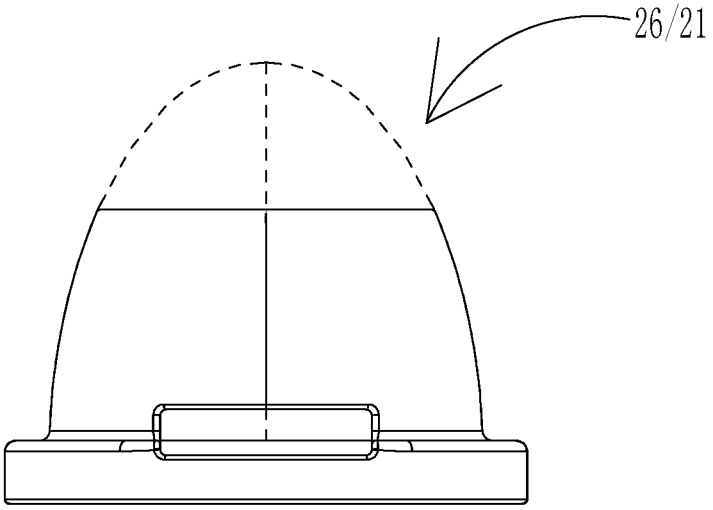
FIG. 10B is a schematic side view of a first guide structure according to an exemplary embodiment.
Figure 10C:
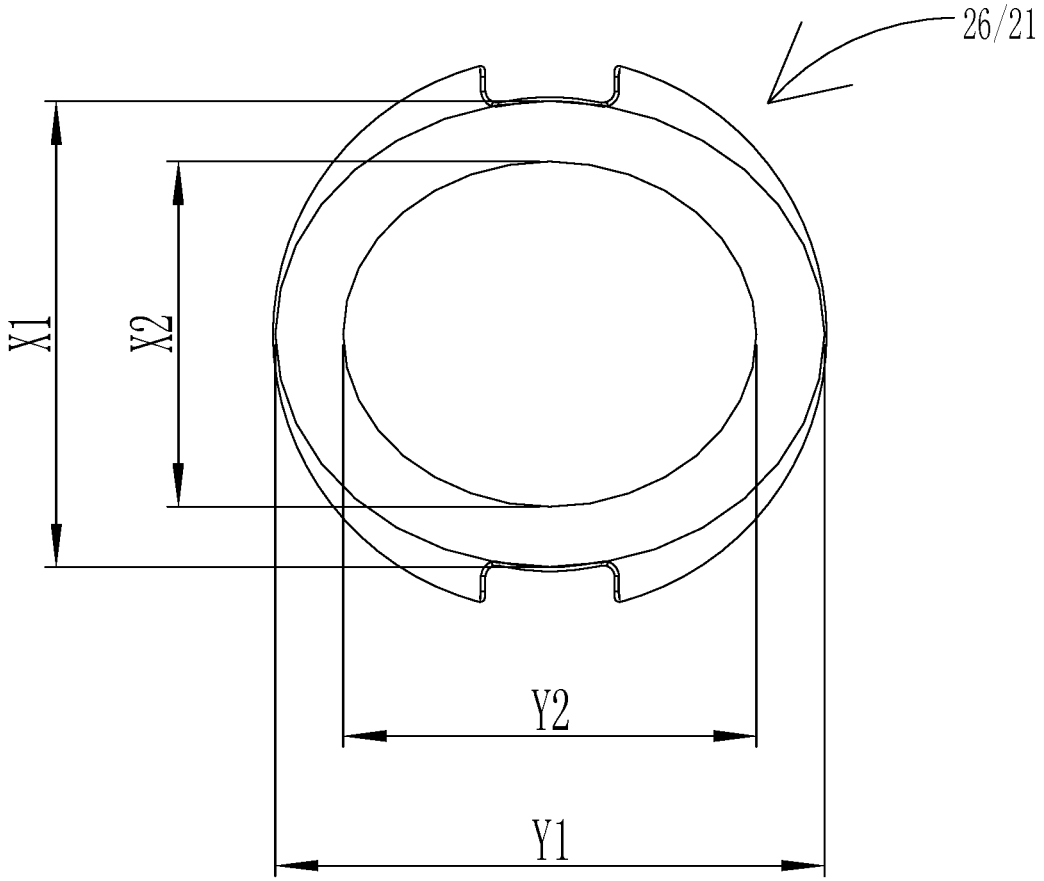
FIG. 10C is a schematic top portion view of a first guide structure according to an exemplary embodiment.
Figure 10D:
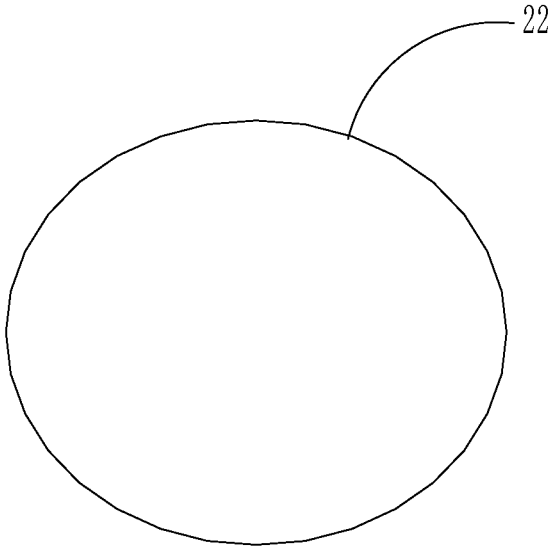
FIG. 10D is a schematic sectional view taken along line A-A in FIG. 10A.
Figure 10E:
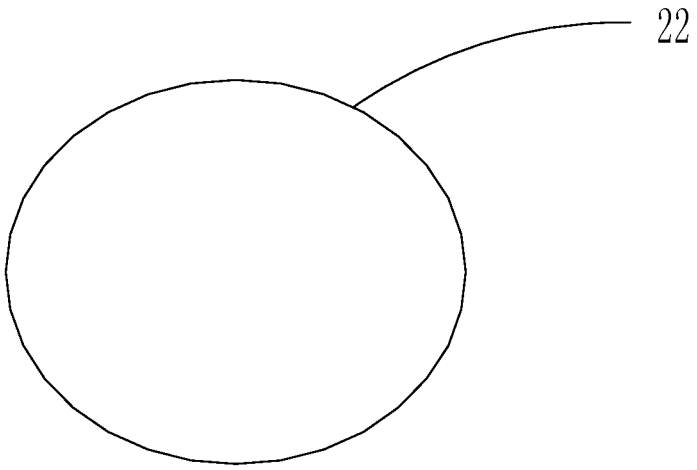
FIG. 10E is a schematic sectional view taken along line B-B in FIG. 10A.
Figure 11A:
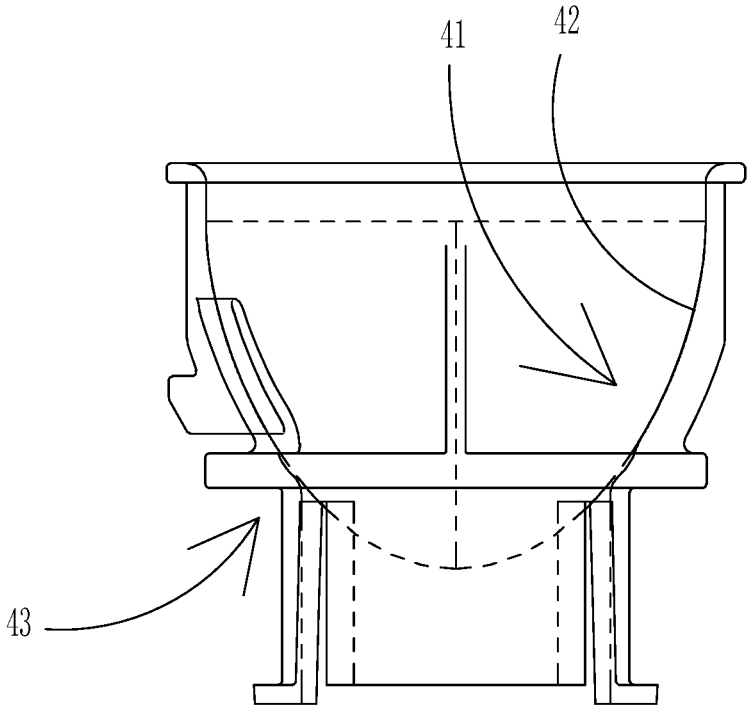
FIG. 11A is a schematic front view of a second guide structure according to an exemplary embodiment.
Figure 11B:
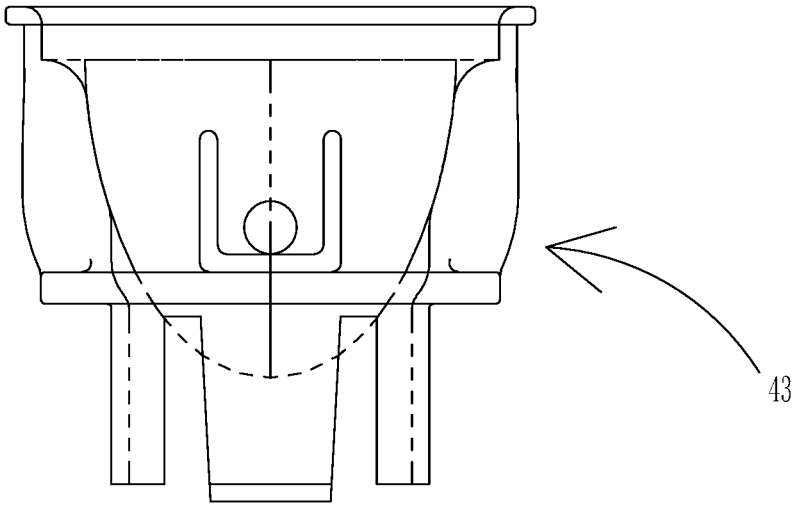
FIG. 11B is a schematic side view of a second guide structure according to an exemplary embodiment.
Figure 11C:
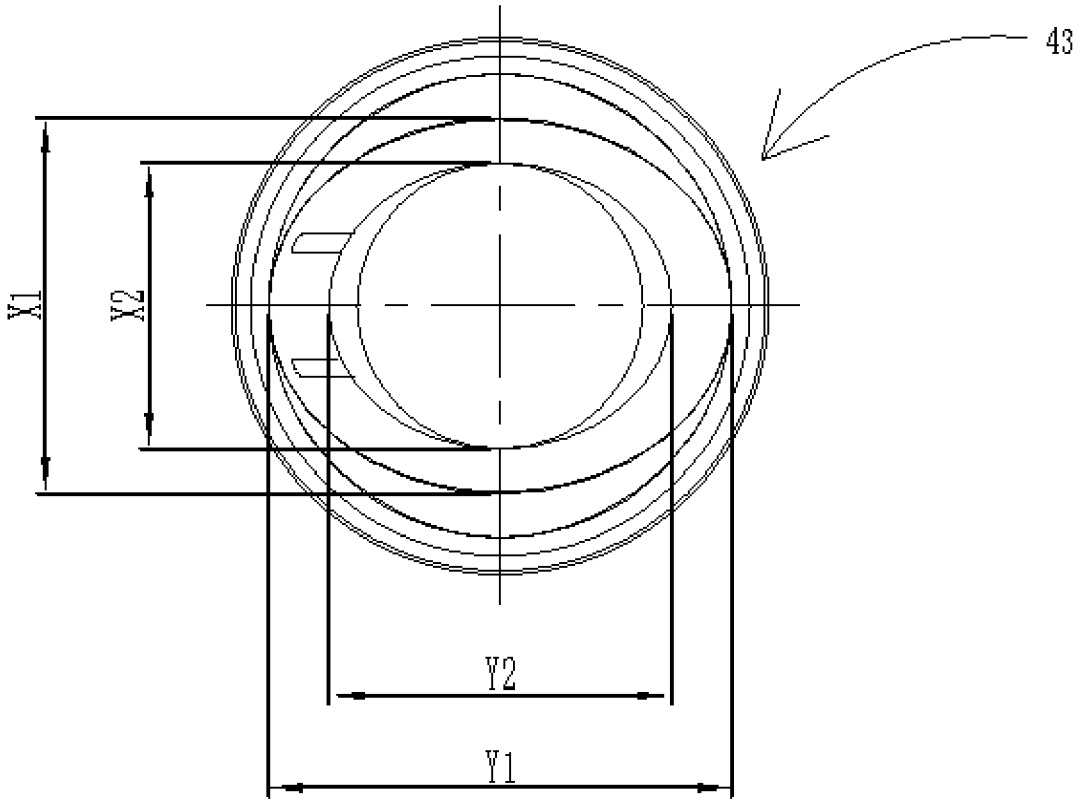
FIG. 11C is a schematic top portion view of a second guide structure according to an exemplary embodiment.
Figure 11D:
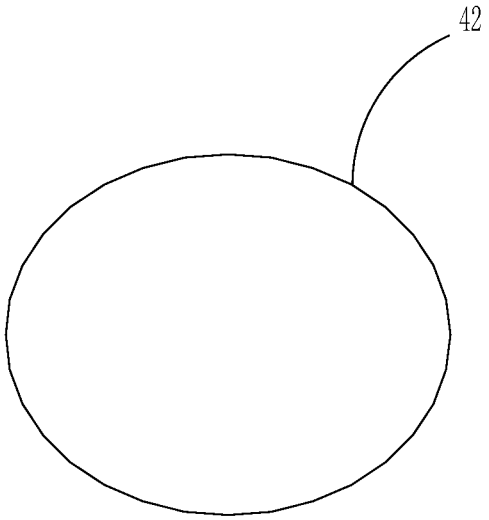
FIG. 11D is a schematic structural view of a concave guide surface corresponding to the line A-A in FIG. 10A.
Figure 11E:
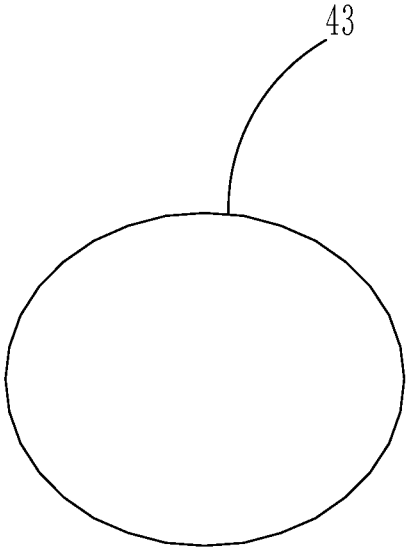
FIG. 11E is a schematic structural view of a concave guide surface corresponding to the line B-B in FIG. 10A.

FIG. 10A is a schematic front view of a first guide structure according to an exemplary embodiment. FIG. 10B is a schematic side view of a first guide structure according to an exemplary embodiment. FIG. 10C is a schematic top portion view of a first guide structure according to an exemplary embodiment. FIG. 10D is a schematic sectional view taken along line A-A in FIG. 10A. FIG. 10E is a schematic sectional view taken along line B-B in FIG. 10A. FIG. 11A is a schematic front view of a second guide structure according to an exemplary embodiment. FIG. 11B is a schematic side view of a second guide structure according to an exemplary embodiment. FIG. 11C is a schematic top portion view of a second guide structure according to an exemplary embodiment. FIG. 11D is a schematic structural view of a concave guide surface corresponding to the line A-A in FIG. 10A. FIG. 11E is a schematic structural view of a concave guide surface corresponding to the line B-B in FIG. 10A.

As shown in the figures, according to the embodiments illustrated in the figures, the sectional shape of the convex guide surface 22 is selected to be an ellipse. Further, the ratio of the Y-axis (or called the major axis) Y1, Y2 to the X-axis (or the short axis) X1, X2 of the ellipse is a, where $0.2 \leq a < 1$ or $1 < a$. Further, optionally, one end of the Y-axis or X-axis direction of the ellipse of the convex guide surface 22 may be selected to be directed to the water-spray switching button 23 so as to align the Y-axis with the water-spray switching button 23 as a reference. It should be understood that the position of the water-spray switching button 23 does not necessarily completely coincide with the orientation of the ellipse of the convex guide surface 22. Instead, the position of the water-spray switching button 23 may have an angle with the Y axis or the X axis direction as long as its angle is identical with the angle of the showerhead socket provided in advance at the mouth of the support member so that the normal reset of the water-spray switching button 23 may be achieved at the end.

In other words, by means of reset and guide effect of the directional convex guide surface 22 and its cooperating concave guide surface 42, the directional outlet portion 2 is reset and guided back to the original aligning position where the outlet portion 2 and the front end of the support member 4 have specific shapes or components aligned with each other.

The convex guide surface 22 of this embodiment is an axially symmetric shape relative to the circumferential surface, and the outer surface with the radius gradually becoming from larger ellipses to smaller ellipses from the lower portion to the top portion relative to the axis is acted as a guide, and the concave guide surface 42 that cooperates therewith is a axially symmetric with the circumferential surface, and the inner surface with the radius gradually becoming from larger ellipses to smaller ellipses from the outside to the inside with respect to the axis serves as a guide. In the process of rotary guide and reset, the outlet portion 2 has to overcome the resetting force of the outlet portion 2 and the hose 3 themselves and the frictional force of the rotary guide. Thus, the resetting force of the counterweight is used to force the entire showerhead to reset upwards to vicinity of the mouth of the pipe, rotate about the concave guide surface 42 and simultaneously move upwards, and finally is automatically guided to two predetermined positions (the water-spray switching button 23 faces forward or backward). The end surface of the outlet portion 2 and the end surface of the showerhead socket 43 of the support member 4 are fitted on each other.

Figure 3:
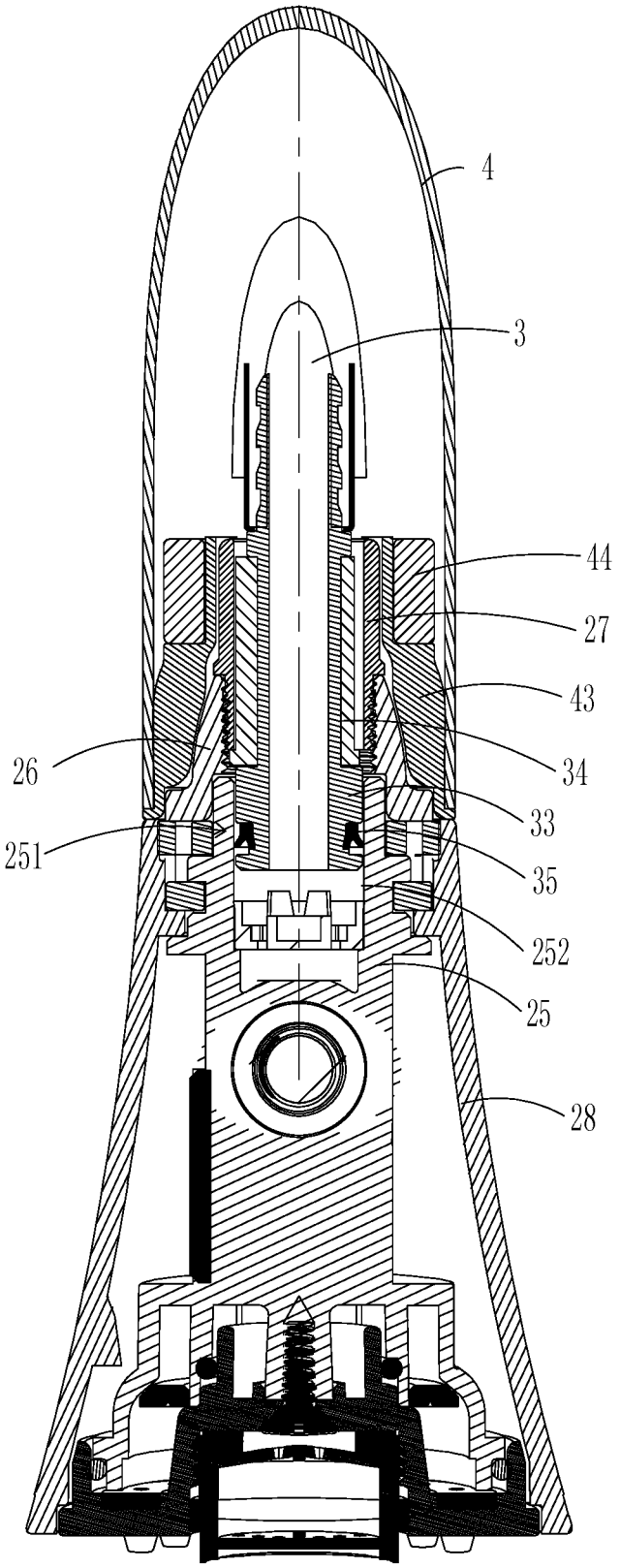
FIG. 3 is a partially enlarged sectional view of an extraction-type water discharging device according to an exemplary embodiment.
Figure 4:
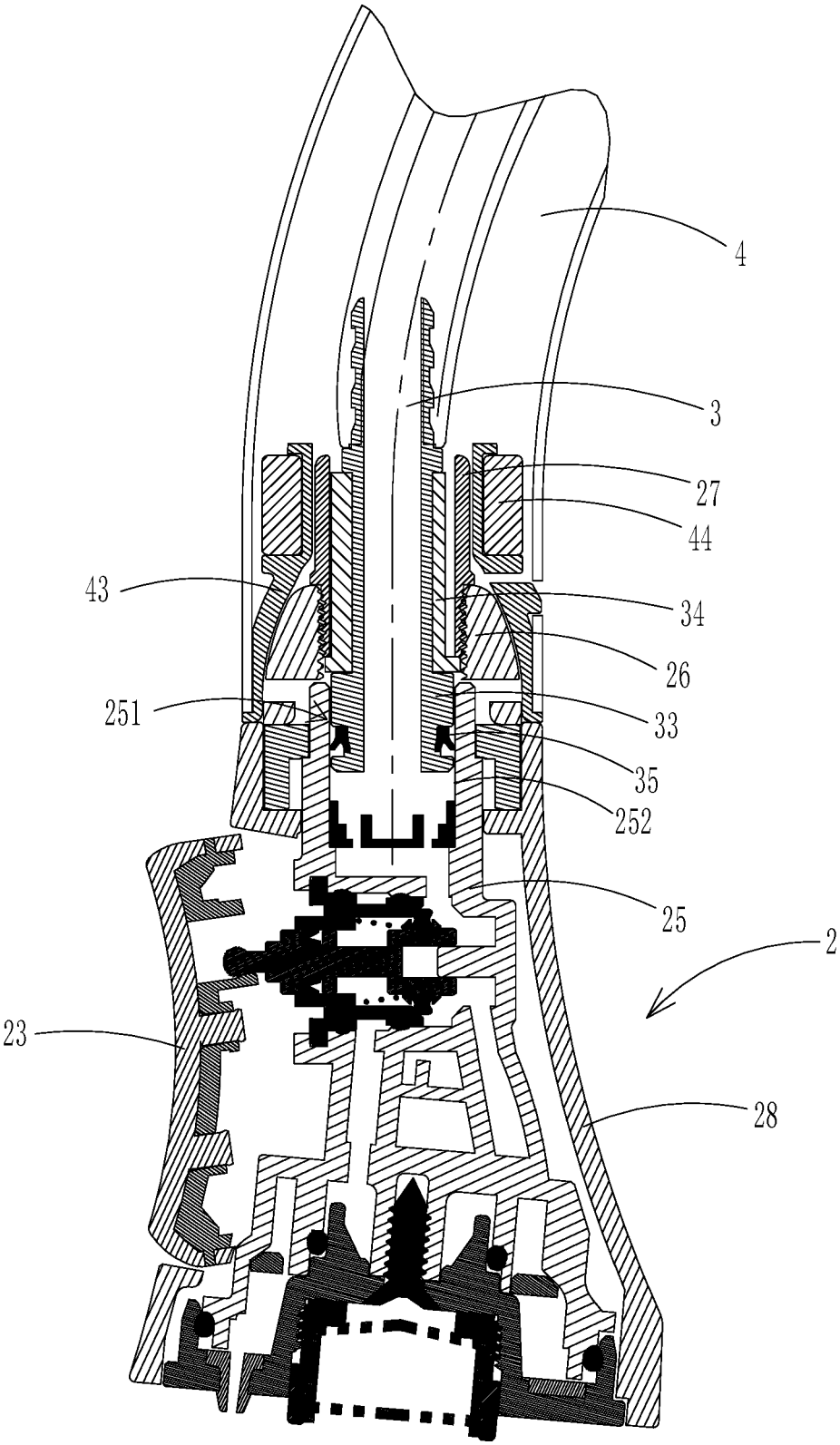
FIG. 4 is a schematic partially enlarged sectional view of another angle of an extraction-type water discharging device according to an exemplary embodiment.

FIG. 3 is a partially enlarged sectional view of an extraction-type water discharging device according to an exemplary embodiment. FIG. 4 is a schematic partially enlarged sectional view of another angle of an extraction-type water discharging device according to an exemplary embodiment.

As shown in the figures, in the specific device examples, the front end surface of the support member 4 has a socket 43 and a magnetically attracting device 44. The socket 43 is formed with a second guide structure 41 corresponding to the outlet portion 2. It should be understood that the second guide structure 41 may also be formed directly on the front end surface of the support member 4 (the previous embodiment may also be understood as such).

For the examples as shown in the figures, one end of the hose 3 has an outlet joint 33, and the outlet portion 2 comprises a mandrel 25, a guide joint 26, a magnetic material joint 27, and a housing 28. The outlet joint 33 is docked with the inlet end 251 of the mandrel 25 which is a lumen 252. Seal is made between the outlet joint 33 and the lumen 252 by sealing members such as sealing rings. The outer side of the outlet joint 33 is subsequently screwed and fixed by the guide joint 26 and the magnetic material joint 27. Seal and positioning is made between the outlet joint 33 and the guide joint 26 and the magnetic material joint 27 by a positioner 34 which may be a common positioning member such as a C-typed snap ring to be used to press tight the interface of the hose 3 and the outlet portion 2. The magnetic material joint 27 corresponds to the magnetically attracting device 44 in the support member 4. The first guide structure 21 is formed at the outer side of the guide joint 26. It should be understood that the magnetic material joint described in this embodiment refers to a joint structure made of a material that may be magnetically attracted by a permanent magnetic or an electromagnetic structure, and may be, but not limited to, iron or stainless iron that may be magnetically attracted.

As shown in the figures, the outlet portion 2 forms a first abutment surface 24 (see FIG. 6) on the outer housing 28 of the first guide structure 21. The socket 43 has a second abutment surface 45 on the outer side of the first guide structure 21. When the outlet portion 2 and the support member 4 abuts against and fit on each other, the first abutment surface 24 and the second abutment surface 45 are docked with and fit on each other.

Figure 5:
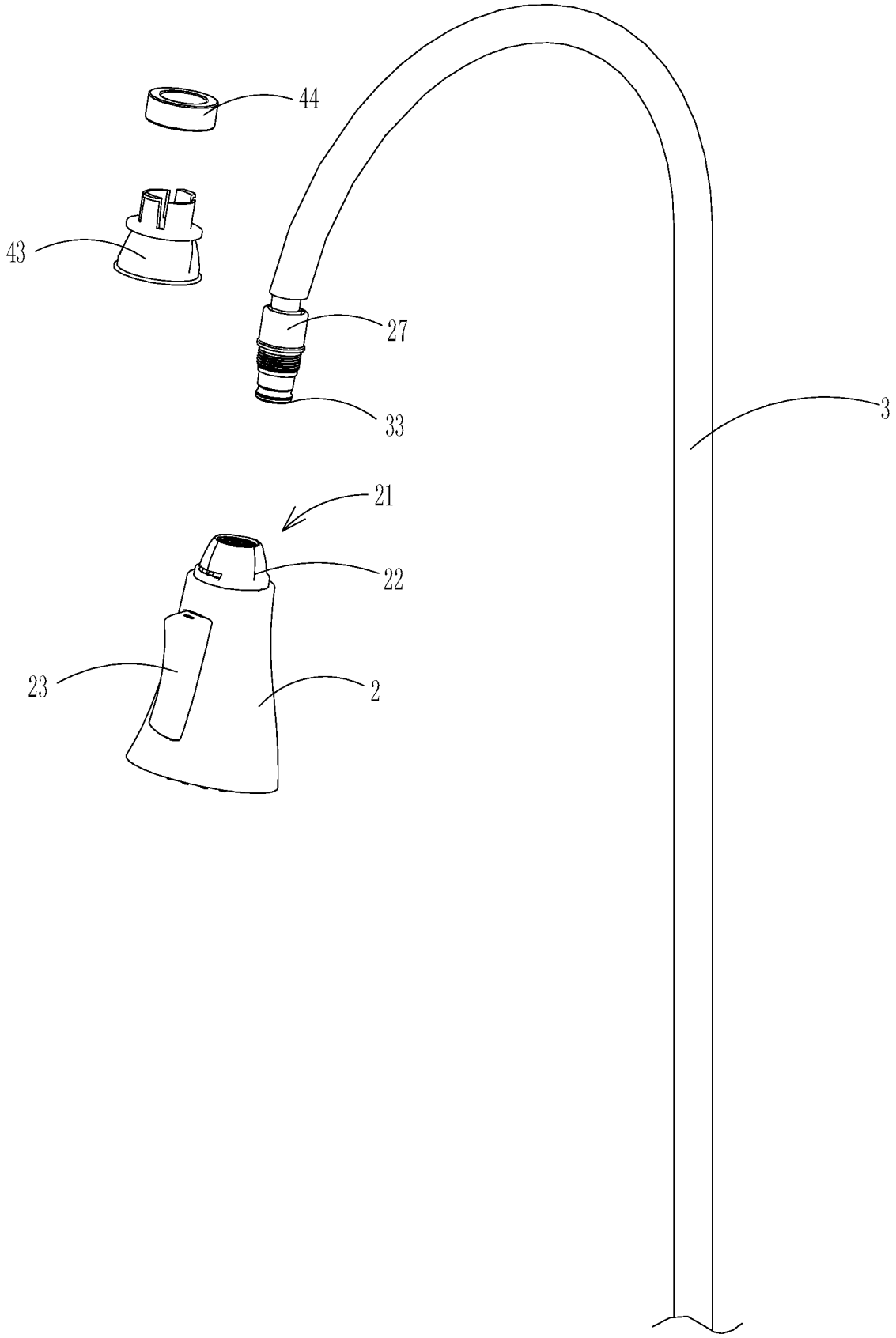
FIG. 5 is a schematic view illustrating the working principle of some components of an extraction-type water discharging device according to an exemplary embodiment.

FIG. 5 is a schematic view illustrating the working principle of some components of an extraction-type water discharging device according to an exemplary embodiment. As shown in FIG. 5, the magnetically attracting device 44 may generate a magnetic attraction force for the magnetic material joint 27 of the outlet portion 2, and the attraction force may be used as an assistantly applied driving force. Under the action of the restoring force of the counterweight 5 and assistant action of the magnetic attraction force of the magnetically attracting device 44, the outlet portion 2 is rotarily moved upward and axially, and finally is guided to reset in the two predetermined directions (the button faces forward or backward), whereby the end surface of the outlet portion 2 fits on and is flush with the end surface of the showerhead socket 43.

Figure 7:
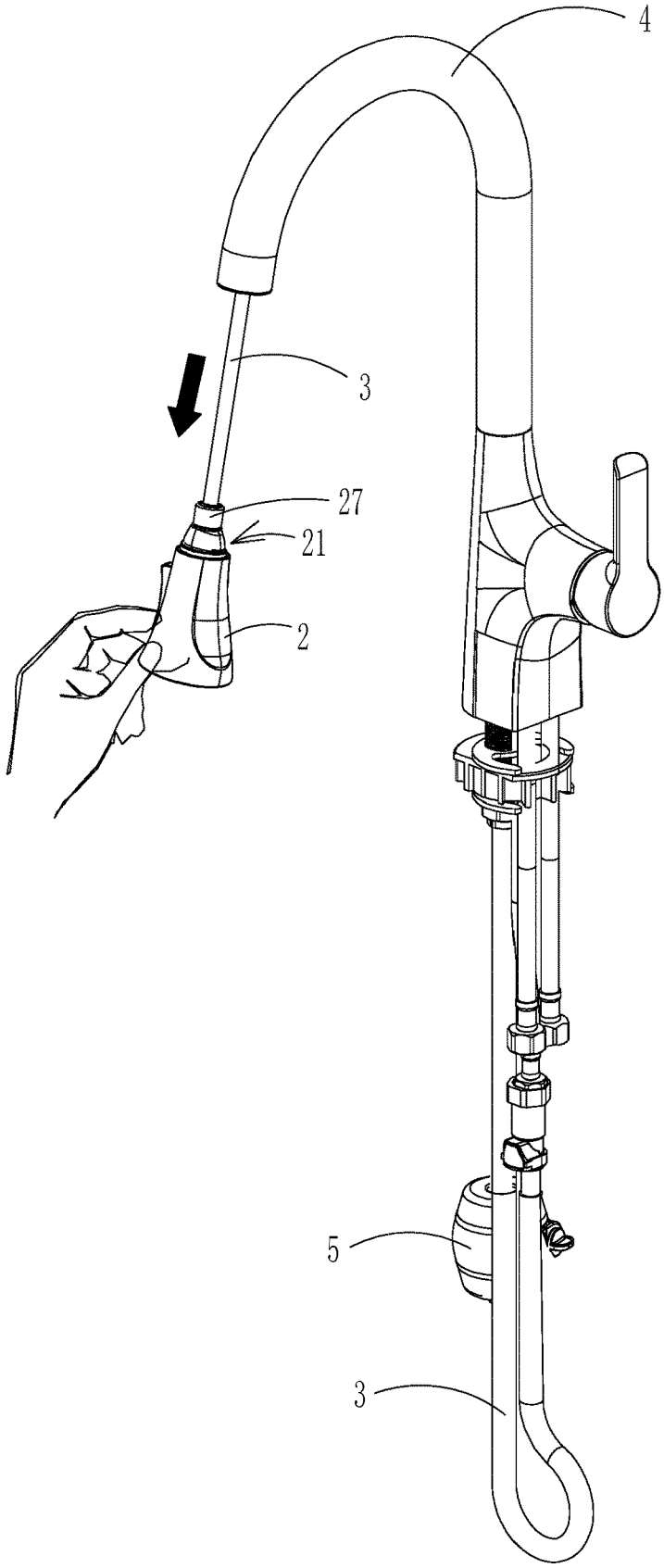
FIG. 7 is a schematic view of an extraction-type water discharging device according to an exemplary embodiment in a state where its outlet portion is extracted away to another angle.
Figure 8:
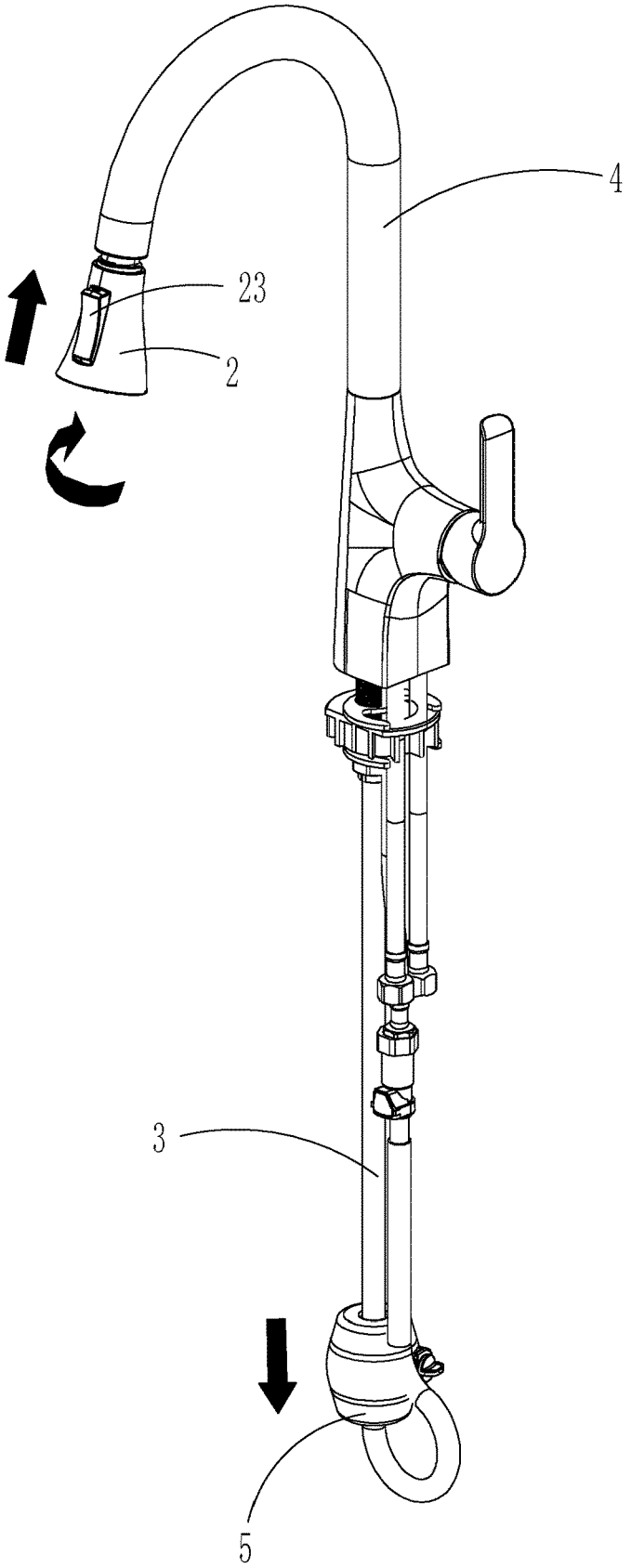
FIG. 8 is a schematic view of an extraction-type water discharging device according to an exemplary embodiment in a state where the outlet portion is reset.
Figure 9:
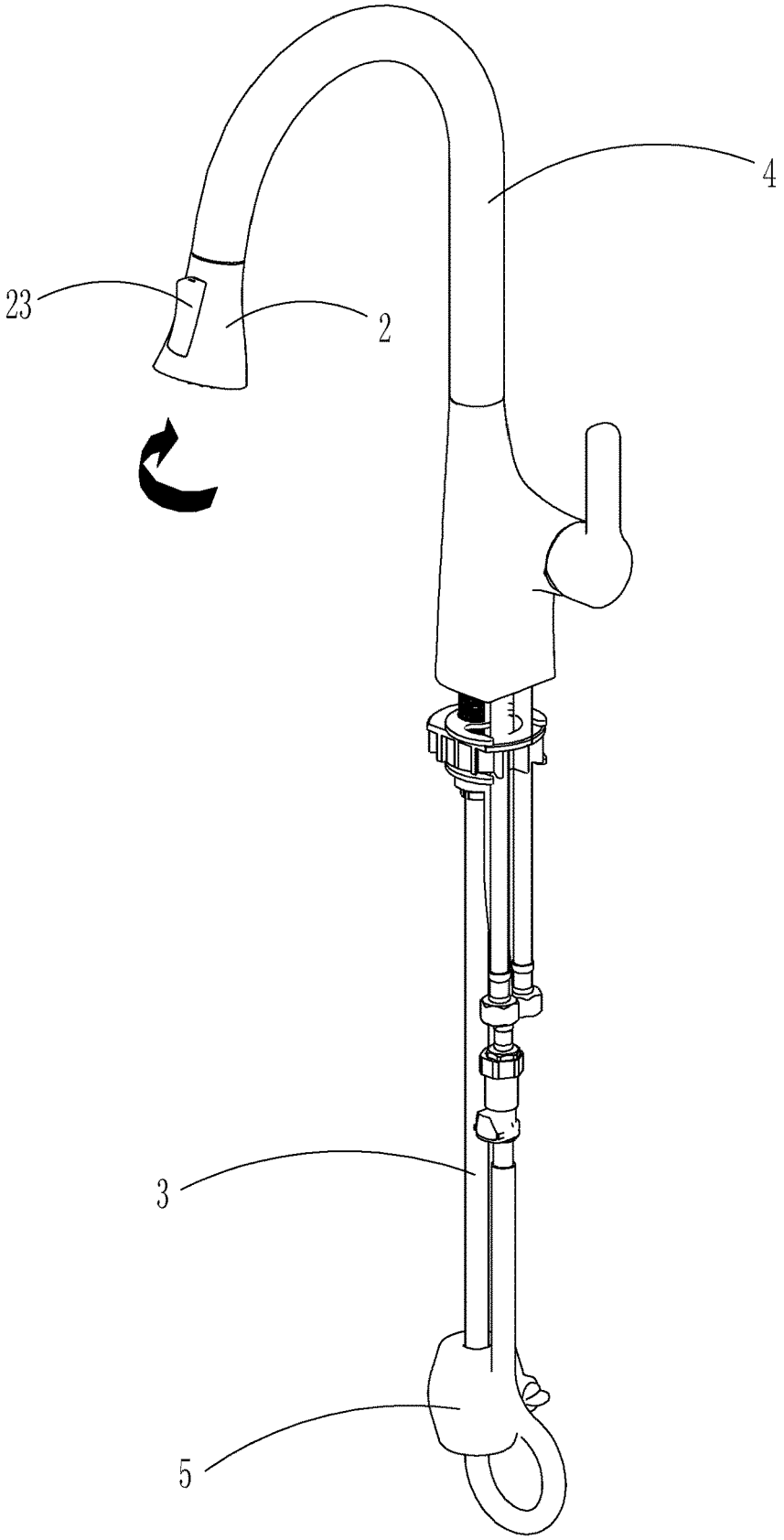
FIG. 9 is a schematic view of an extraction-type water discharging device according to an exemplary embodiment, after the state where the outlet portion is reset.

FIG. 7 is a schematic view of an extraction-type water discharging device according to an exemplary embodiment in a state where its outlet portion is extracted away to another angle. FIG. 8 is a schematic view of an extraction-type water discharging device according to an exemplary embodiment in a state where the outlet portion is reset. FIG. 9 is a schematic view of an extraction-type water discharging device according to an exemplary embodiment, after the state where the outlet portion is reset.

As shown in the figures, the embodiments of the present disclosure provide an extraction-type water discharging device with automatically guided reset. The working principle lies in that the non-circular axially symmetrical gradually changing curved surface of the convex guide surface 22 of the guide structure of the outlet portion 2 is used to match with that of the inner concave guide surface 42 of the cooperating support member 4. The convex guide surface 22 and the concave guide surface 42 are similar in shape and size and have parallel fitting clearance. When the convex guide surface 22 falls into the concave guide surface 42, the convex guide surface 22 and the concave guide surface 42 have only two small balanced contact points and cannot maintain the balanced state. In such a case, the outlet portion 2 with the convex guide surface 22 is automatically rotarily guided along the concave guide surface 42 to reset, forcing the convex guide surface 22 to completely fall into the concave guide surface 42. Finally, the two curved surfaces become parallel, and the end surface 24 of the outlet portion 2 fits on the end surface 45 of the showerhead socket 43.

Figure 12A:
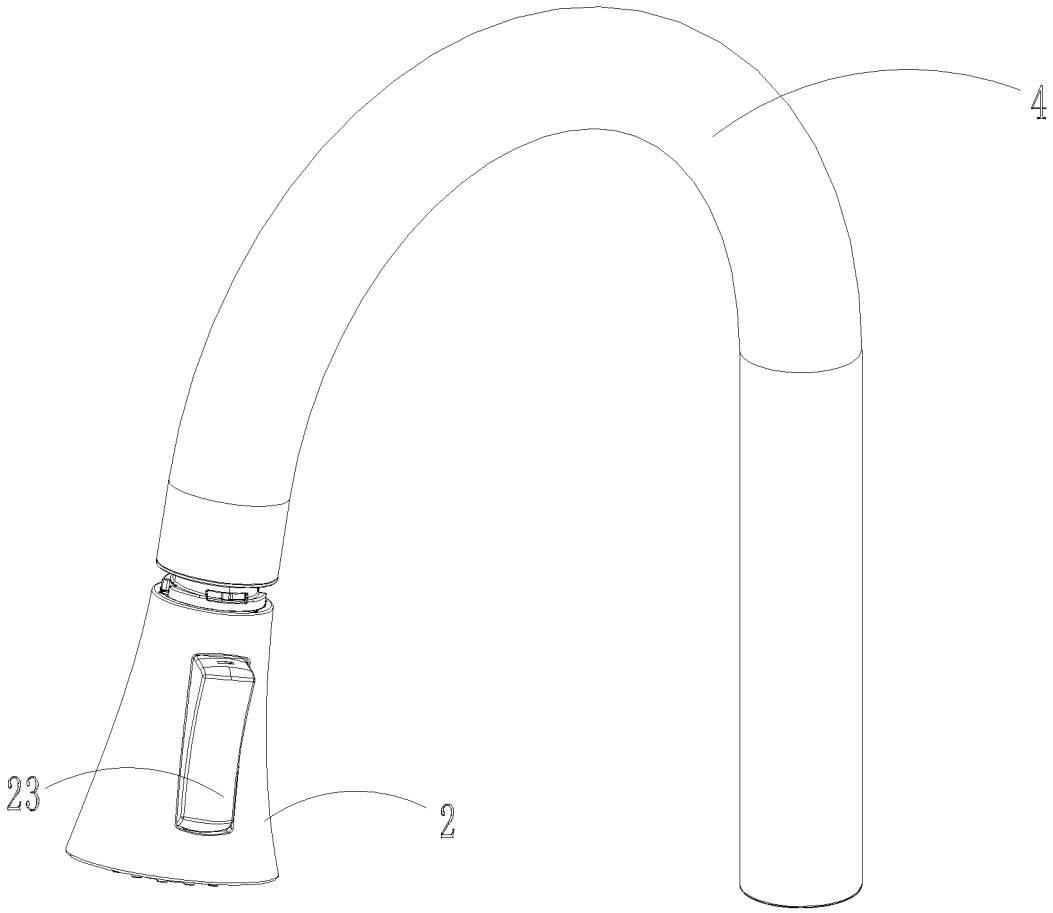
FIG. 12A is a schematic structural view of an appearance of an extraction-type water discharging device according to an exemplary embodiment at a reset starting stage.
Figure 12B:
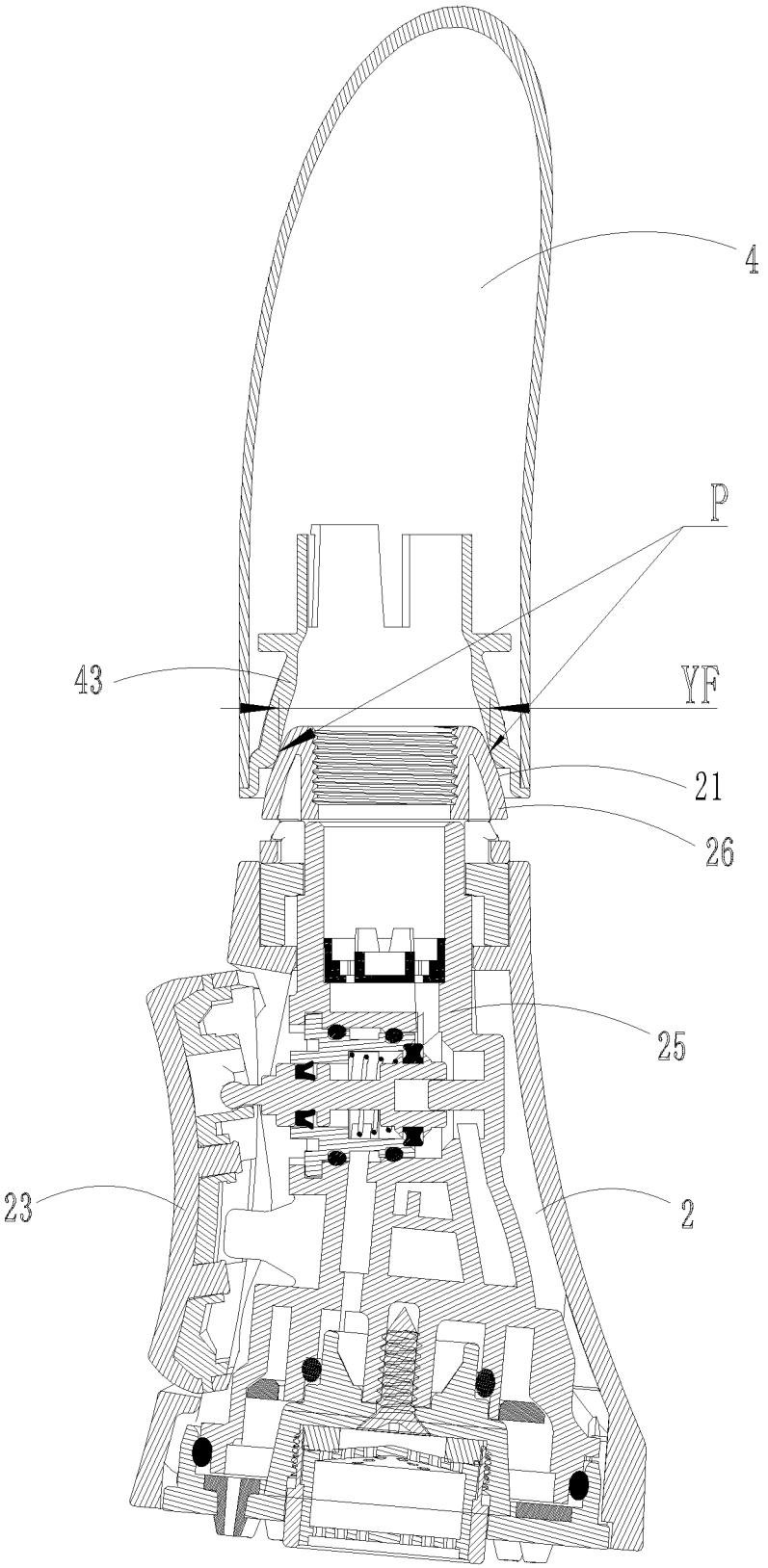
FIG. 12B is a schematic structural sectional view of an extraction-type water discharging device in a radial direction at a reset starting stage according to an exemplary embodiment.
Figure 12C:
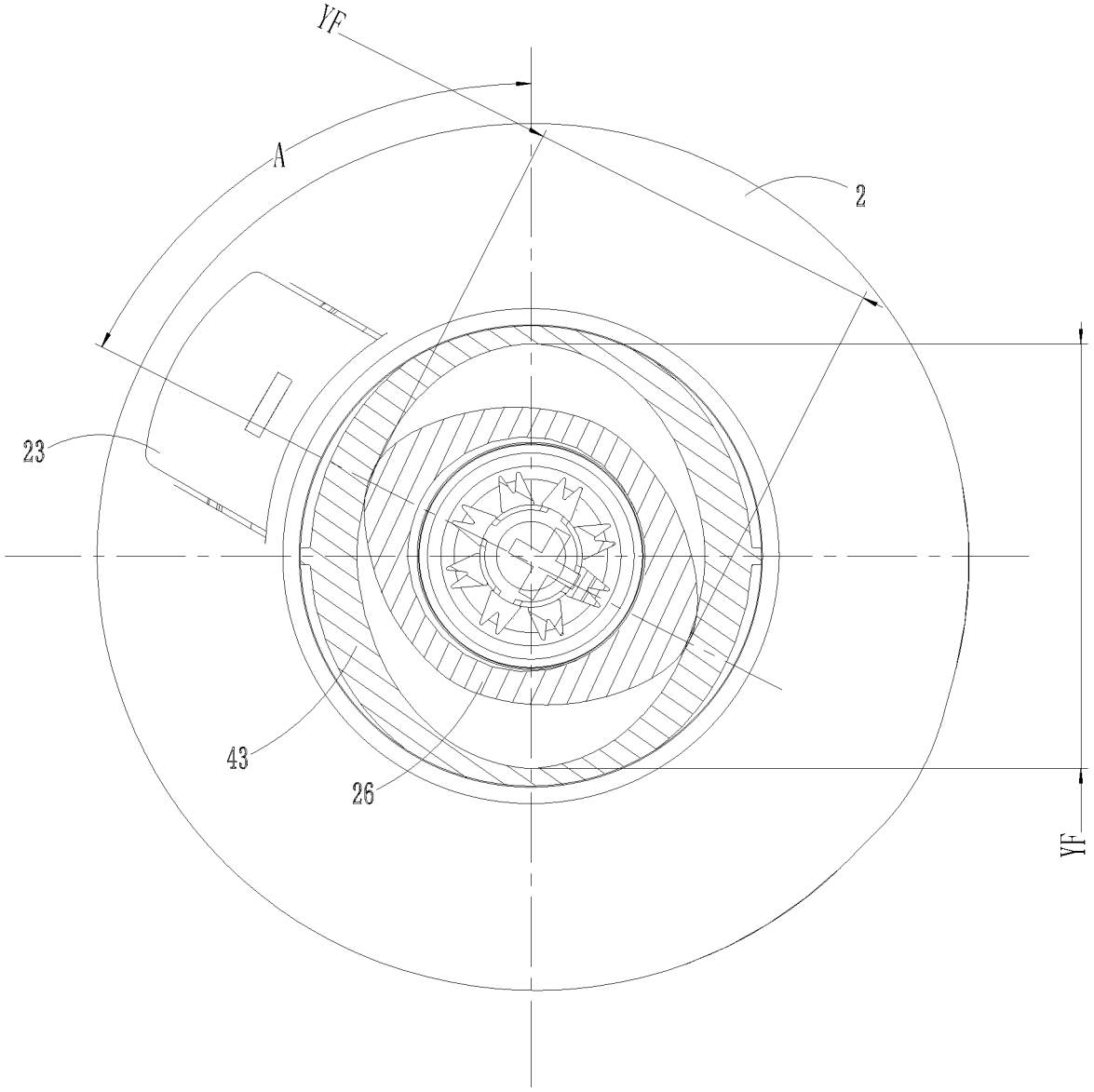
FIG. 12C is a schematic structural sectional view of an extraction-type water discharging device in an axial direction at a reset starting stage according to an exemplary embodiment.

Now, an exemplary illustration of the reset process of an extraction-type water discharging device according to an embodiment of the present disclosure is made step by step as follows:

FIG. 12A is a schematic structural view of an appearance of an extraction-type water discharging device according to an exemplary embodiment at a reset starting stage. FIG. 12B is a schematic structural sectional view of an extraction-type water discharging device in a radial direction at a reset starting stage according to an exemplary embodiment. FIG. 12C is a schematic structural sectional view of an extraction-type water discharging device in an axial direction at a reset starting stage according to an exemplary embodiment. As shown in the figures, when the guided reset is started, the first guide structure 21 (convex outer shape) just lands on the second guide structure 22 (concave cavity). If viewed from the radial section, the first guide structure 21 has two small contact points P in the long-axial direction YF of the top of the outer shape which firstly come into contact with the inner cavity of the second guide structure 22. If viewed from the axial section, there is an angle between the long-axial direction of the top of the first guide structure 21 and the long-axial direction of the second guide structure 22.

Figure 13A:
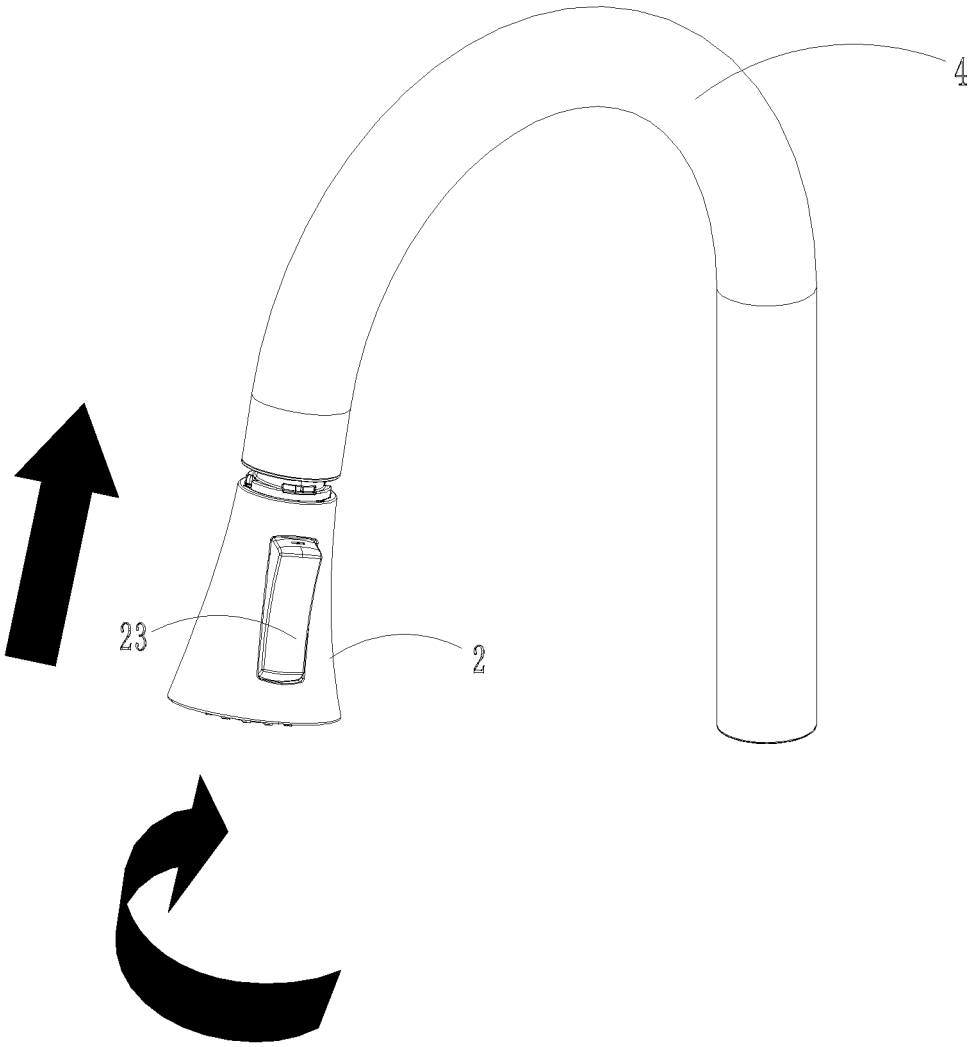
FIG. 13A is a schematic structural view of an appearance of an extraction-type water discharging device at a reset going stage according to an exemplary embodiment.
Figure 13B:
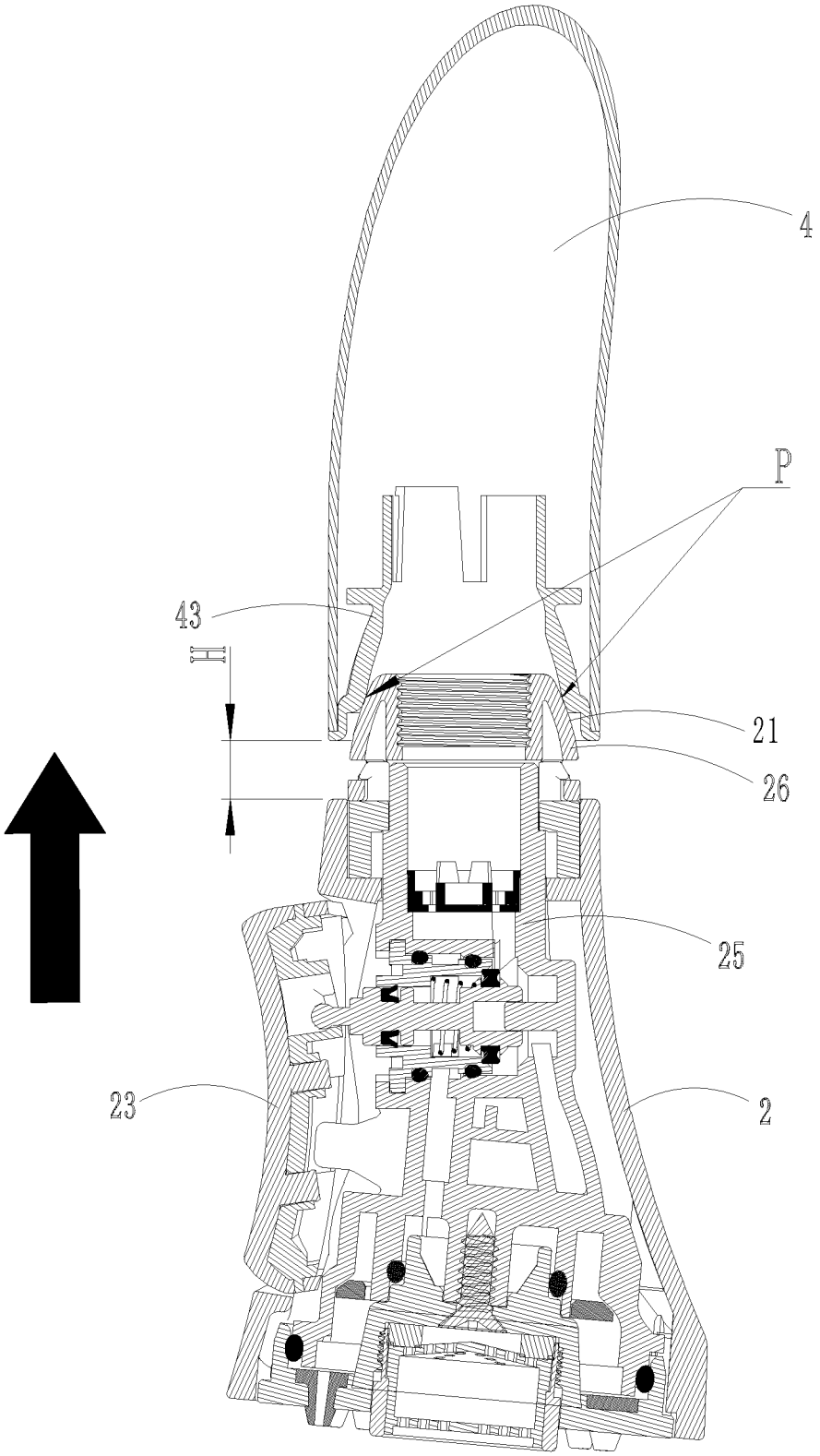
FIG. 13B is a schematic structural sectional view of an extraction-type water discharging device in a radial direction at a reset going stage according to an exemplary embodiment.
Figure 13C:
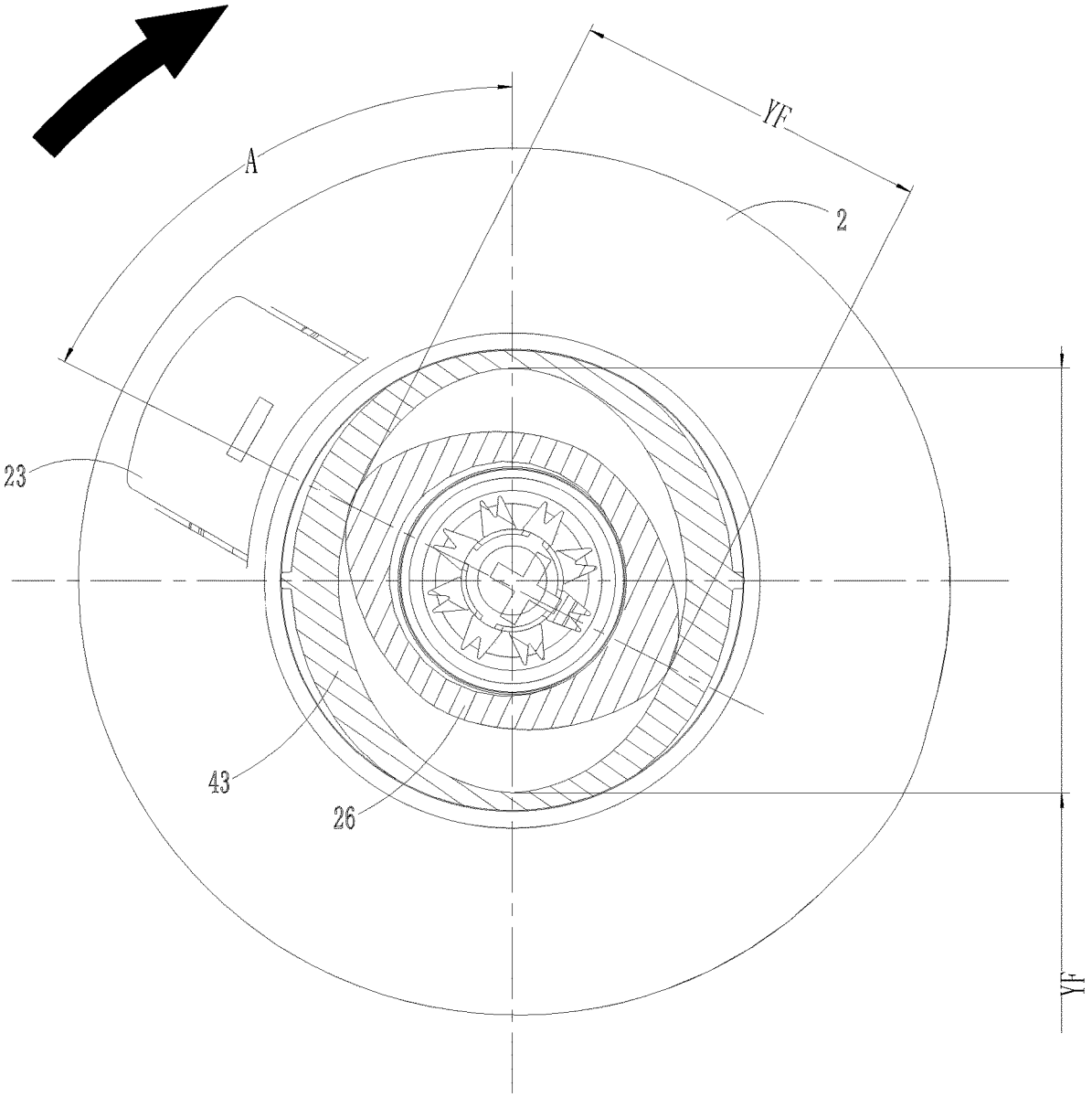
FIG. 13C is a schematic structural sectional view of an extraction-type water discharging device in an axial direction at a reset going stage according to an exemplary embodiment.

FIG. 13A is a schematic structural view of an appearance of an extraction-type water discharging device at a reset going stage according to an exemplary embodiment. FIG. 13B is a schematic structural sectional view of an extraction-type water discharging device in a radial direction at a reset going stage according to an exemplary embodiment. FIG. 13C is a schematic structural sectional view of an extraction-type water discharging device in an axial direction at a reset going stage according to an exemplary embodiment. As shown in the figures, during reset, depending on the principle that the two-point contact is unbalanced, with the assistant action of external forces such as the gravity of the counterweight, the magnetically attraction force of the magnets, the resilient forces of the springs and electrically powered pulling force, the two small contact points P in the long-axial direction YF of the top of the outer shape of the first guide structure of the outlet portion 2 is made to radially approach the longitudinal direction YF of the inner layer of the inner cavity of the second guide structure 22 so that the axial guide space H between the two end surfaces thereof is reduced to fit on each other, and at the same time is made to axially rotate so that the included angle between the long axis of the first guide structure 21 and that of the second guide structure 22 is reduced to align.

Figure 14A:
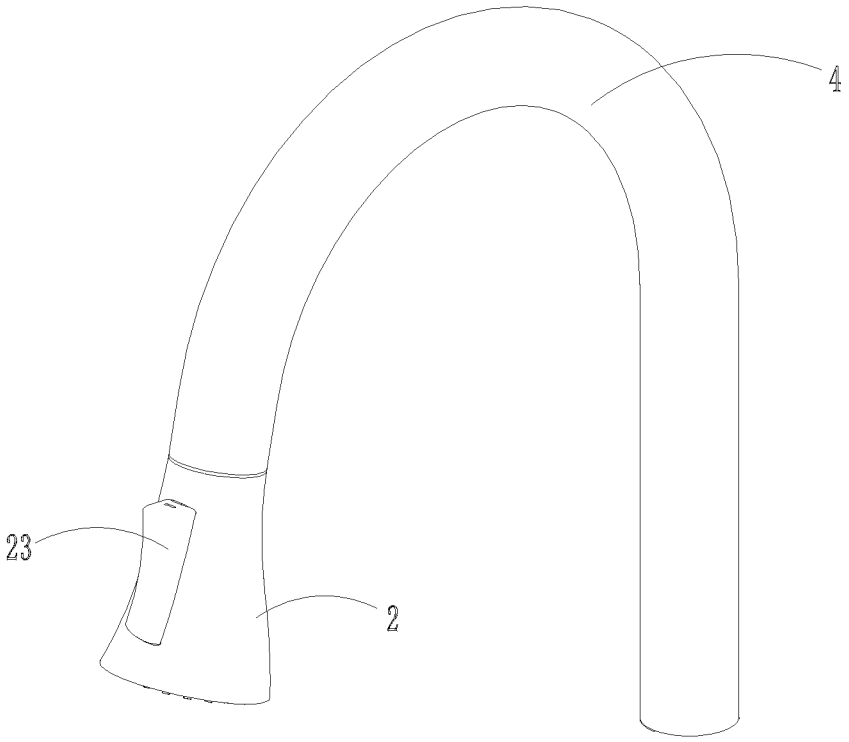
FIG. 14A is a schematic structural view of the appearance of an extraction-type water discharging device at a reset ending stage according to an exemplary embodiment.
Figure 14B:
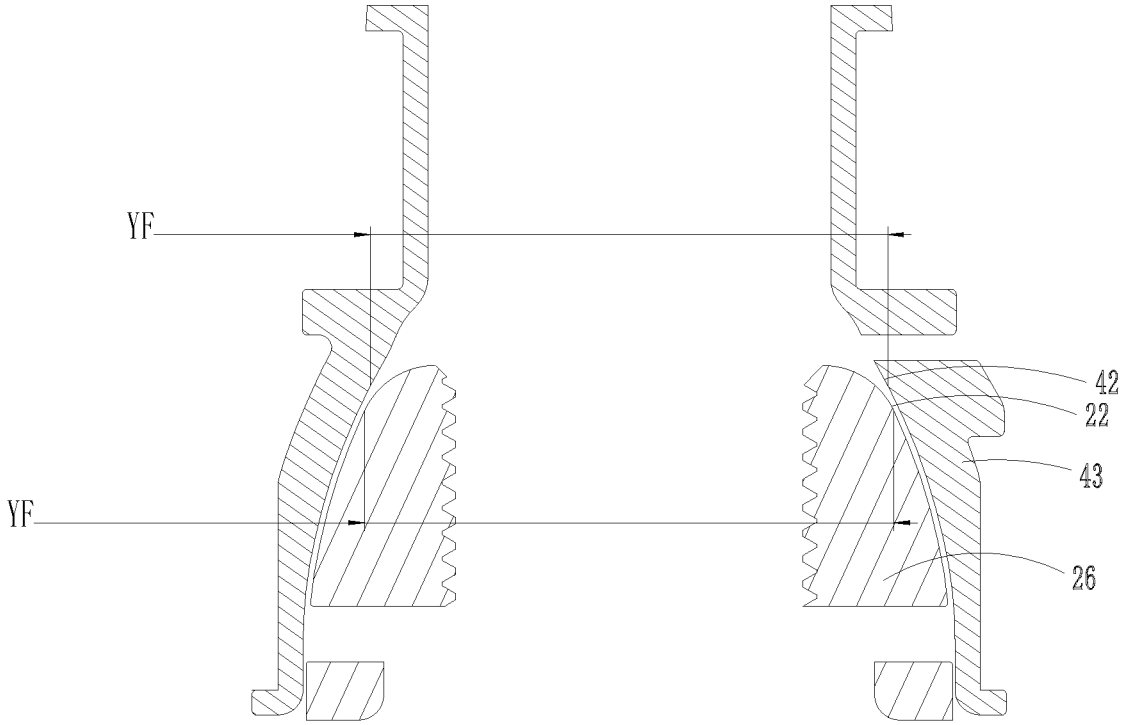
FIG. 14B is a schematic structural sectional view of an extraction-type water discharging device in a long-axial direction at a reset ending stage according to an exemplary embodiment.
Figure 14C:
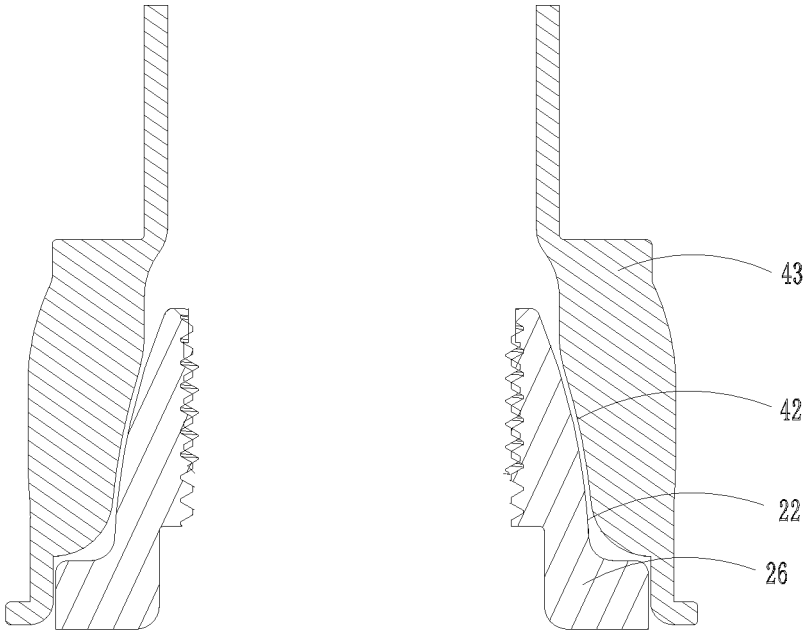
FIG. 14C is a schematic structural sectional view of an extraction-type water discharging device in a short-axial direction at a reset ending stage according to an exemplary embodiment.
Figure 14D:
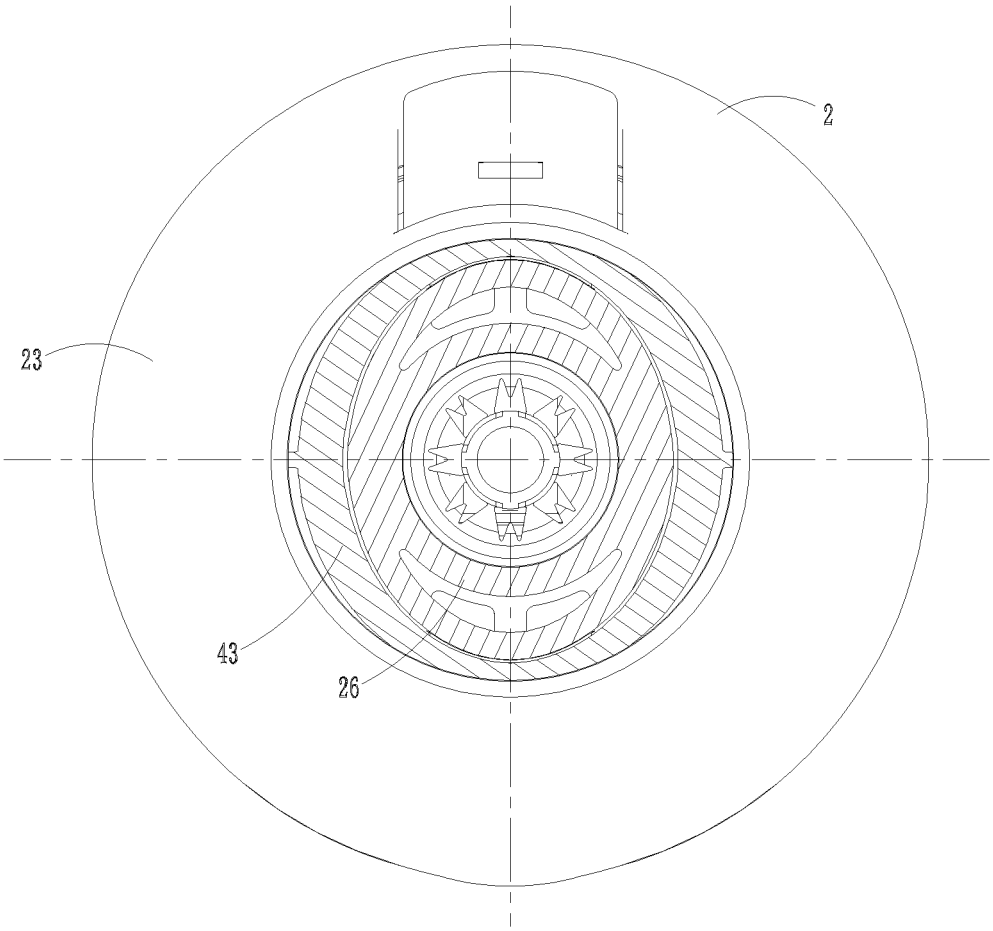
FIG. 14D is a schematic structural sectional view of an extraction-type water discharging device in an axial direction at a reset ending stage according to an exemplary embodiment.

FIG. 14A is a schematic structural view of the appearance of an extraction-type water discharging device at a reset ending stage according to an exemplary embodiment. FIG. 14B is a schematic structural sectional view of an extraction-type water discharging device in a long-axial direction at a reset ending stage according to an exemplary embodiment. FIG. 14C is a schematic structural sectional view of an extraction-type water discharging device in a short-axial direction at a reset ending stage according to an exemplary embodiment. FIG. 14D is a schematic structural sectional view of an extraction-type water discharging device in an axial direction at a reset ending stage according to an exemplary embodiment. As shown in the figures, at the end of the guided reset, the end surface of the outlet portion 2 radially abuts against and fits on the end surface of the support member 4, and is axially rotated and reset to the predetermined position of the long axial direction YF. The long axis of the outer shape of the first guide structure 21 is aligned with the long-axial direction YF of the inner cavity of the second guide structure 22. Of course, their short-axial directions are also correspondingly aligned. As may be seen from the figures, the outer shape of the first guide structure 21 and the inner cavity of the second guide structure 22 are similar in size and shape and fitted with clearance.

FIG. 15 is a schematic structural view of appearance of an extraction-type water discharging device according to another exemplary embodiment. As shown in the figure, the difference from the foregoing embodiment is in that, in this embodiment, the outlet portion 2 is not limited to provision of the water-spray switching button. For example, the outlet portion 2 of the type as shown in the figure is not provided with a water-spray switching button. Optionally, the water-spray may be switched by ways such as rotary switch. Here, a relatively fixed orientation is predetermined between the profile direction of the outlet portion 2 and the automatically guided reset. As such, the resetting direction of the outlet portion 2 may be reset according to the automatically guided reset direction.

Figure 16A:
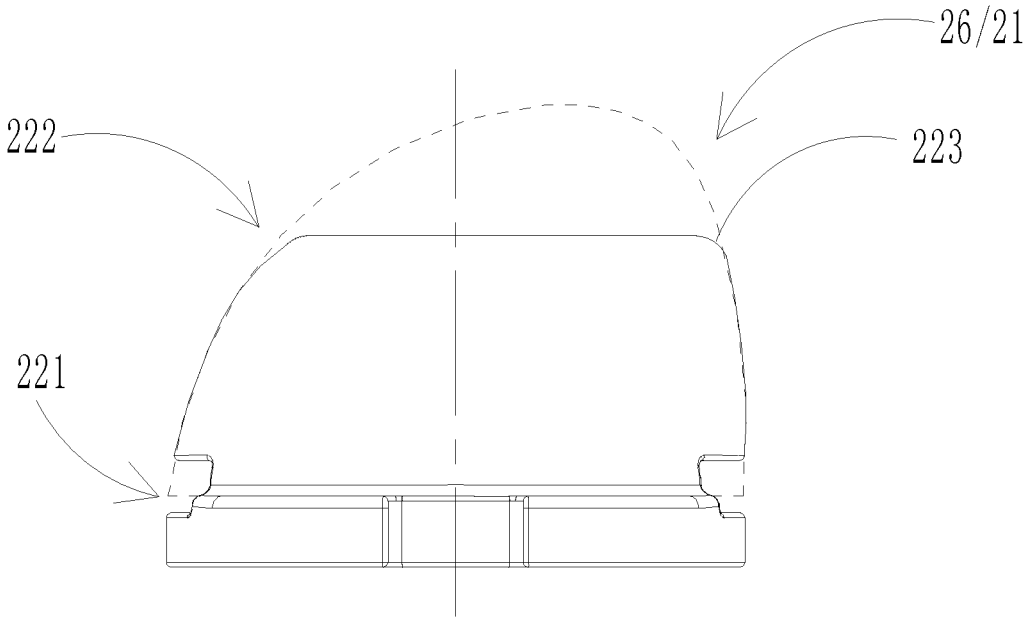
FIG. 16A is a schematic front view of a first guide structure according to another exemplary embodiment.
Figure 16B:
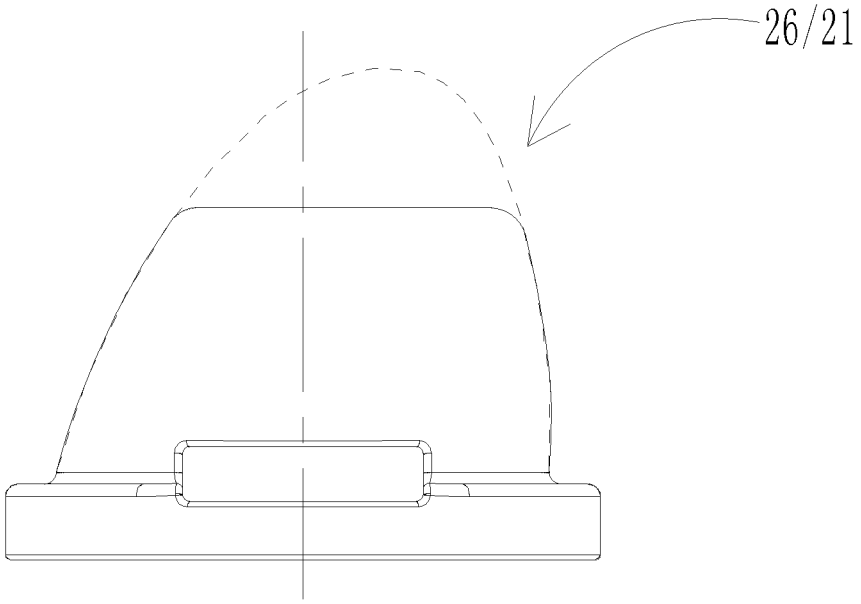
FIG. 16B is a schematic side view of a first guide structure according to another exemplary embodiment.
Figure 16C:
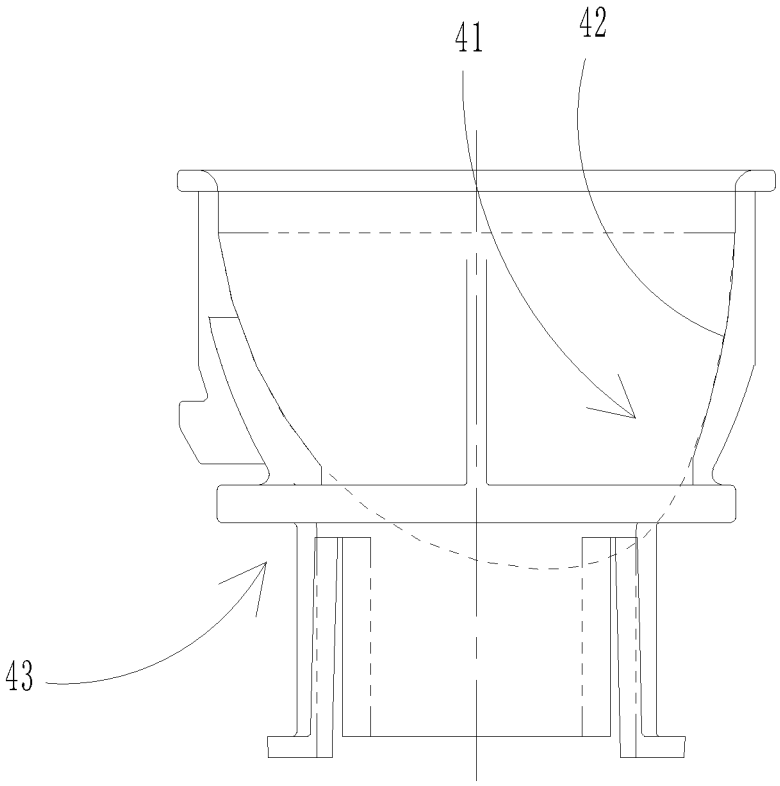
FIG. 16C is a schematic front view of a second guide structure according to another exemplary embodiment.
Figure 16D:
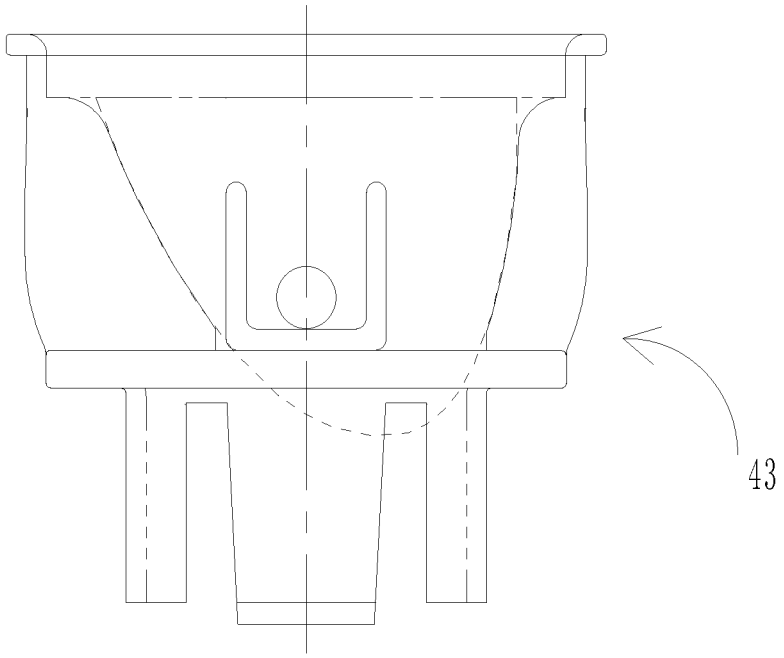
FIG. 16D is a schematic side view of a second guide structure according to another exemplary embodiment.

FIG. 16A is a schematic front view of a first guide structure according to another exemplary embodiment. FIG. 16B is a schematic side view of a first guide structure according to another exemplary embodiment. FIG. 16C is a schematic front view of a second guide structure according to another exemplary embodiment. FIG. 16D is a schematic side view of a second guide structure according to another exemplary embodiment.

As shown in the figure, the difference from the foregoing embodiment is in that in the cooperating structure of the first guide structure 21 and the second guide structure 41 in the present embodiment, the side-viewed shapes of the convex guide surface 22 and the concave guide surface 42 may be selected as the axially asymmetrical smooth curves, that is to say, may be selected to have an offset towards one side, having a shape like a mango. Such a shape has better directional selectivity, and has more clear directivity during a guided reset operation.

It can be known from the above technical solutions that the extraction-type water discharging device of the embodiments of the present disclosure has advantageous effect over the prior art at least in that, during extraction and reset of the outlet portion, when the outlet portion abuts against and fits on the support member, the convex guide surface is embedded in the concave guide surface provided in the end surface of the support member. The radially eccentric smooth curve of the outer shape of the convex guide surface of the water discharging can be utilized to fit the radially eccentric smooth curve of the concave guide surface of the inner cavity of the second guide structure. The convex guide surface and the concave guide surface of the inner cavity are similar in shape and size, and have parallel fitting clearances. When the convex guide surface falls into the concave guide surface, if they are not aligned, the convex guide surface and the concave guide surface have only two unbalanced small contact points and cannot reach equilibrium. In this case, the outlet portion with the convex guide surface will follow the inner surface of the concave guide surface to be automatically rotated and guided to reset, forcing the convex guide surface to completely fall into the inner cavity surface. Finally, the two curved surfaces become parallel, and the end surface of the outlet portion fits on the end surface of the showerhead socket.

Of course, once the above description of the representative embodiments is carefully considered, those skilled in the art will readily understand that various modifications, additions, substitutions, deletions, and other changes may be made to these specific embodiments, and these changes are within the scope of the inventive concept. Accordingly, the foregoing detailed description is to be clearly understood as given by way of illustration and example only. The spirit and scope of the present disclosure is defined only by the appended claims and their equivalents.

What is claimed is:

1. An extraction-type water discharging device, comprising:

an outlet portion;

a support member;

a hose, the hose is in communication with the outlet portion at one end and the other end passes through the support member; and a first guide structure, the first guide structure is provided in the outlet portion corresponding to the support member;

a second guide structure, the second guide structure is provided in the support member corresponding to the outlet portion; wherein one of the first and second guide structures is a convex guide surface, and an other one is a concave guide surface cooperating with the convex guide surface, the convex guide surface is smoothly tapered from a base portion to a top portion, and the concave guide surface flares smoothly and gradually from a bottom portion to a top portion, a sectional shape of the convex guide surface and the concave guide surface respectively have at least one smooth curve eccentric towards radial direction; and a resetting member, the resetting member is configured to act on the hose, under the action of the reset member, the first and second guide structures are configured to guide a radial alignment and an axial rotational movement such that the outlet portion is reset to be aligned with and fits on the support member.

2. The extraction-type water discharging device according to claim 1, wherein the sectional shape of the convex and concave guide surfaces respectively have a radially symmetrically eccentric smooth curve.

3. The extraction-type water discharging device according to claim 2, wherein the convex guide surface has the sectional shape of an ellipse, and the first and second guide structures are coaxially arranged.

4. The extraction-type water discharging device according to claim 3, wherein a ratio of the Y-axis to the X-axis of the ellipse is a, where $0.2 \leq a < 1$ or $1 < a$.

5. The extraction-type water discharging device according to claim 4, wherein the support member further comprises a socket which is positioned at a front end of the support member, and is provided with the second guide structure corresponding to the outlet portion.

6. The extraction-type water discharging device according to claim 5, wherein the outlet portion has a first abutment surface at the outer side of the first guide structure, and the socket has a second abutment surface at the outer side of the first guide structure, wherein when the outlet portion is brought into abutment against and fitness on the support member, the first abutment surface abuts against and fits on the second abutment surface.

7. The extraction-type water discharging device according to claim 5, wherein the hose has an outlet joint at one end of the hose, the outlet portion comprises a mandrel, a guide joint and a magnetic material joint, wherein the outlet joint is docked with an inlet end of the mandrel, and sequentially screwed and fixed by the guide joint and the magnetic material joint so as to press tight an interface of the hose and the outlet portion, the support member is further provided with a magnetically attracting device corresponding to the outlet portion, wherein the magnetic material joint corresponds to the magnetically attracting device, the first guide structure is formed at the outer side of the guide joint.

8. The extraction-type water discharging device according to claim 2, wherein the support member further comprises a socket which is positioned at a front end of the support member, and is provided with the second guide structure corresponding to the outlet portion.

9. The extraction-type water discharging device according to claim 8, wherein the outlet portion has a first abutment surface at an outer side of the first guide structure, and the socket has a second abutment surface at an outer side of the first guide structure, wherein when the outlet portion is brought into abutment against and fitness on the support member, the first abutment surface abuts against and fits on the second abutment surface.

10. The extraction-type water discharging device according to claim 8, wherein the hose has an outlet joint at the one end of the hose, the outlet portion comprises a mandrel, a guide joint and a magnetic material joint, wherein the outlet joint is docked with an inlet end of the mandrel, and sequentially screwed and fixed by the guide joint and the magnetic material joint so as to press tight an interface of the hose and the outlet portion, the support member is further provided with a magnetically attracting device corresponding to the outlet portion, wherein the magnetic material joint corresponds to the magnetically attracting device, the first guide structure is formed at the outer side of the guide joint.

11. The extraction-type water discharging device according to claim 1, wherein the sectional shape of the convex and concave guide surfaces respectively have a sectional shape of a radially asymmetrically eccentric smooth curve.

12. The extraction-type water discharging device according to claim 1, wherein the convex and concave guide surfaces respectively have a side-viewed shape of an axially symmetrical smooth curve.

13. The extraction-type water discharging device according to claim 1, wherein the convex and concave guide surfaces respectively have a side-viewed shape of an axially asymmetric smooth curve.

14. The extraction-type water discharging device according to claim 1, wherein the first guide structure is the convex guide surface which is embedded into the concave guide surface provided in an end portion of the support member when the outlet portion abuts against and fits on the support member.

15. The extraction-type water discharging device according to claim 1, wherein the outlet portion has an outer shape with directionality, and the convex guide surface has the sectional shape of an ellipse, wherein the outer shape with directionality of the outlet portion is enabled to reset following the convex guide surface when the outlet portion has been extracted and then reset relative to the support member.

16. The extraction-type water discharging device according to claim 1, wherein the support member is further provided with a magnetically attracting device corresponding to the outlet portion to generate a magnetic attraction force for the outlet portion.

17. The extraction-type water discharging device according to claim 16, wherein the support member further comprises a socket which is positioned at a front end of the support member, and is provided with the second guide structure corresponding to the outlet portion.

18. The extraction-type water discharging device according to claim 1, wherein the support member further comprises a socket which is positioned at a front end of the support member, and is provided with the second guide structure corresponding to the outlet portion.

19. The extraction-type water discharging device according to claim 18, wherein the outlet portion has a first abutment surface at an outer side of the first guide structure, and the socket has a second abutment surface at an outer side of the first guide structure, wherein when the outlet portion is brought into abutment against and fitness on the support member, the first abutment surface abuts against and fits on the second abutment surface.

20. The extraction-type water discharging device according to claim 18, wherein the hose has an outlet joint at the one end of the hose, the outlet portion comprises a mandrel, a guide joint and a magnetic material joint, wherein the outlet joint is docked with an inlet end of the mandrel, and sequentially screwed and fixed by the guide joint and the magnetic material joint so as to press tight an interface of the hose and the outlet portion, the support member is further provided with a magnetically attracting device corresponding to the outlet portion, wherein the magnetic material joint corresponds to the magnetically attracting device, the first guide structure is formed at the outer side of the guide joint.

* * * * *